US008282192B2

(12) United States Patent
Koseki

(10) Patent No.: US 8,282,192 B2
(45) Date of Patent: Oct. 9, 2012

(54) HEAD CHIP UNIT AND METHOD OF PRODUCING THE SAME, INKJET HEAD, AND INKJET PRINTER

(75) Inventor: Osamu Koseki, Chiba (JP)

(73) Assignee: SII Printek Inc. (JP)

( * ) Notice: Subject to any disclaimer, the term of this patent is extended or adjusted under 35 U.S.C. 154(b) by 1138 days.

(21) Appl. No.: 12/070,325

(22) Filed: Feb. 14, 2008

(65) Prior Publication Data

US 2008/0211868 A1 Sep. 4, 2008

(30) Foreign Application Priority Data

Feb. 23, 2007 (JP) ..... 2007-043648

(51) Int. Cl.
*B41J 2/14* (2006.01)

(52) U.S. Cl. ..... 347/40

(58) Field of Classification Search ..... None
See application file for complete search history.

(56) References Cited

U.S. PATENT DOCUMENTS 4,392,145 A 7/1983 Parkola ..... 346/140
4,605,939 A 8/1986 Hubbard et al. ..... 346/140
5,289,209 A * 2/1994 Suzuki et al. ..... 347/71

FOREIGN PATENT DOCUMENTS

EP 0786342 7/1997

* cited by examiner

*Primary Examiner* — Jerry Rahll
(74) *Attorney, Agent, or Firm* — Adams & Wilks

(57) ABSTRACT

A head chip unit comprises a first head chip having a first ink chamber configured to contain first ink and having a first channel in communication with the first ink chamber for receiving the first ink from the first ink chamber and via which the first ink is discharged in an ink supply direction of the head chip unit. A second head chip is laminated with the first head chip along a laminating direction generally orthogonal to the ink supply direction. The second head chip has a second ink chamber with an ink supply part configured to receive second ink different from the first ink, a second channel in communication with the second ink chamber for receiving the second ink from the ink supply part and via which the second ink is discharged in the ink supply direction, and an ink supply hole through which the second ink is supplied into the ink supply part of the second ink chamber, the ink supply hole extending in the laminating direction so that the ink supply hole does not overlap the first ink chamber and the first channel of the first head chip.

23 Claims, 18 Drawing Sheets

HEAD CHIP UNIT AND METHOD OF PRODUCING THE SAME, INKJET HEAD, AND INKJET PRINTER

BACKGROUND OF THE INVENTION

1. Field of the Invention

The present invention relates to a head chip unit and a method of producing the same for performing printing by discharging ink, an inkjet head including the head chip unit, and an inkjet printer including the inkjet head.

2. Description of the Related Art

Conventionally, as means for recording a character, an image, and the like on a medium such as paper, there has been used an inkjet printer for performing printing by discharging ink. The inkjet printer includes an inkjet head for discharging ink and a carriage for allowing the inkjet head to scan in a direction substantially orthogonal to a medium transport direction. The inkjet head includes a head chip including a plurality of channels each having an electrode formed on a wall surface thereof. A voltage is applied to each electrode from a wiring board connected to the head chip, to thereby change a volume of each of the channels to which ink is supplied. As a result, the ink is discharged from each of the channels through nozzles, thereby making it possible to perform printing.

In this case, printing in a plurality of colors can be performed in such a manner that a plurality of inkjet heads corresponding to the kinds of ink are mounted to discharge a plurality of colors of ink. However, there are problems in that the number of inkjet heads to be mounted is increased, a printer including the inkjet heads is increased in size, and costs thereof are increased. In addition, it is necessary to perform positioning of each of the inkjet heads, which makes the carriage having the inkjet heads mounted thereto complicated. For this reason, in recent years, there has been proposed a technology of printing which can be performed using a plurality of kinds of ink with a single inkjet head while achieving both miniaturization and printing in a plurality of colors. Specifically, there is proposed an inkjet head including: a base plate in which channels are formed; a head chip unit in which a plurality of head chips, each of which is formed of a cover plate disposed on the base plate, are laminated; and a wiring board connected to the cover plate of each of the head chips (for example, see JP 10-146974 A). In addition, there is proposed an inkjet head including: a head chip unit having two rows of channels which are formed on both surfaces of a single head chip; and a wiring board connected to the both surfaces (for example, see JP 2001-315353 A).

However, in the head chip unit mounted to the inkjet head as described in JP 10-146974 A, the channels arranged in a plurality of rows are disclosed, but means for supplying ink to each of the channels is not disclosed. Accordingly, a plurality of kinds of ink cannot be discharged from the channels in each row. Further, in the head chip unit mounted to the inkjet head as described in JP2001-315353 A, the channels in each row communicate with different ink chambers, thereby enabling discharge of different kinds of ink, but at most two kinds of ink can be discharged in the structure. For this reason, both of the head chip units have not achieved a technique of discharging a plurality of kinds of ink while achieving miniaturization.

SUMMARY OF THE INVENTION

The present invention has been made in view of the above-mentioned circumstances, and therefore an object of the present invention is to provide a head chip unit and a method of producing the same capable of discharging a plurality of kinds of ink while achieving both miniaturization and printing in a plurality of kinds of ink, an inkjet head including the head chip unit, and an inkjet printer including the inkjet head.

In order to achieve the above-mentioned object, the present disclosure discloses the following aspects of the invention.

A head chip unit according to the present invention includes:

a head chip having a substantially plate shape including:

a channel extending from one edge side to another edge side to be opened on the another edge side; and an ink chamber formed in an arrangement direction orthogonal to a supply direction for forming the channel and communication with the channel on the one edge side, the head chip being laminated in multiple, characterized in that:

the ink chamber of at least one of the head chip includes a supply part formed until a position where the supply part is not overlapped with the channel and the ink chamber of another head chip in a laminating direction of the head chip, the another head chip being laminated on a surface of the at least one of the head chip; and the another head chip laminated on the surface of at least one of the head chip including the supply part, includes an ink supply hole which is formed so that the ink supply hole is opened on the one side and penetrates the head chip so as to communicate with the supply part.

In another aspect, a method of producing a head chip unit according to the present invention includes:

a head chip having a substantially plate shape forming step of forming a channel extending from one edge side of the head chip main body to another edge side thereof to be opened on the another edge side, and an ink chamber extending in an arrangement direction orthogonal to a supply direction for forming the channel and communicating with the channel on the one edge side;

a lamination step of laminating a plurality of the head chips formed in the head chip forming step; and an ink supply hole forming step of forming an ink supply hole opened on one side of the head chip to be laminated and penetrating in a laminating direction of the head chip, characterized in that:

the head chip forming step includes forming as a part of the ink chamber a supply part in at least one of the head chip, which extends until a position where the supply part is not overlapped with the channel and the ink chamber of another head chip in a laminating direction of the head chip, the another head chip being laminated on the surface of the head chip in the lamination step; and the ink supply hole forming step includes forming the ink supply hole corresponding to the supply part at a position where the ink supply hole communicates with the supply part.

In the head chip unit and the method of producing the head chip unit according to the present invention, the channel and the ink chamber are formed in the head chip main body to thereby produce a head chip in the head chip forming step, and a plurality of the head chips are laminated in the lamination step. As a result, in at least one of the head chips, the supply part is formed as a part of each of the ink chambers at a position where the supply part is not overlapped with the channel and the ink chamber of another head chip, which is laminated on the surface of the head chip. Further, by the ink supply hole forming step, the another head chip, which is laminated on the surface of the head chip having the supply part formed therein, and the ink supply hole opened on the one side are formed so as to communicate with the supply part. For this reason, to the channel of the head chip including the ink chamber having the supply part, the ink different in kind from that of the another head chip can be supplied from the ink supply hole through the ink chamber, and can be discharged from opening formed on the another edge side of the channel. Accordingly, a plurality of kinds of ink can be discharged so as to correspond to the number of ink chambers each having the supply part and the number of ink supply holes to be formed so as to correspond to the supply parts.

Further, in the head chip unit, it is preferred that:

at least one of the head chip includes a plurality of the channel and a plurality of the ink chamber;

the plurality of the ink chambers each include the supply part and communicate with the different channels; and the another head chip laminated on the one side of the head chip including the supply part includes a plurality of the ink supply holes formed therein in correspondence with the supply parts.

Further, in the method of producing a head chip unit, it is preferred that the head chip forming step further includes forming a plurality of the channels in at least one of the head chip, and forming a plurality of the ink chambers so that the plurality of ink chambers each include the supply part and communicate with the plurality of different channels; and the ink supply hole forming step further includes forming a plurality of the ink supply holes in correspondence with the respective supply parts of the plurality of the ink chambers.

In the head chip unit and the method of producing the head chip unit according to the present invention, the plurality of ink chambers are formed in one head chip in the head chip forming step, the supply part is formed in the respective ink chambers, and the plurality of ink supply holes are formed so as to correspond to the supply parts in the ink supply hole forming step. As a result, with a single head chip, different kinds of ink can be supplied to each of the plurality of channels from each of the ink supply holes through the ink chambers to be discharged.

Still further, in the head chip unit, it is preferred that the ink chamber of the head chip includes:

a main body part formed in the arrangement direction and communicating with the channel; and an introduction part formed in the supply direction at a position where the introduction part is not overlapped with the channel in the laminating direction to be connected to the main body part; and the supply part is provided to the introduction part.

Yet further, in the method of producing a head chip unit, it is preferred that the head chip forming step further includes forming a main body part as the ink chamber in at least one of the head chip, which extends in the arrangement direction and communicates with the channels, and an introduction part, which extends in the supply direction and connects to the main part at a position where the introduction part is not overlapped with the channel in the laminating direction, to thereby form the supply part to the introduction part.

In the head chip unit and the method of producing the head chip unit according to the present invention, the main body part and the introduction part are formed and the supply part is formed to the introduction part in the head chip forming step. As a result, a width of the head chip main body in the arrangement direction is set to a minimum size for forming the channels and the introduction part of the ink chambers, and positions of the supply parts and the corresponding ink supply holes can be arbitrarily set in the supply direction in which the channels are formed. Accordingly, even when a plurality of supply parts and the corresponding ink supply holes are formed, the head chip unit is not increased in size with the minimum width in the arrangement direction, thereby making it possible to supply a plurality of kinds of ink to be discharged.

Yet further, in the head chip unit, it is preferred that the head chip includes at least four sets of the ink supply part of the ink chamber and the ink supply hole corresponding to the supply part, which are independently provided.

In the head chip unit according to the present invention, the supply parts of the ink chambers and the ink supply holes corresponding to the supply parts are independently provided in at least four sets. As a result, four colors of ink, that is, yellow, magenta, cyan, and black can be separately discharged, thereby making it possible to perform printing in various colors according to a discharge amount of each ink.

Further, an inkjet head according to the present invention is characterized by including the head chip unit.

In the inkjet head according to the present invention, a plurality of kinds of ink can be discharged from a single head chip unit, whereby miniaturization is achieved while printing with a plurality of kinds of ink can be performed.

Further, an inkjet printer according to the present invention includes the inkjet head.

The inkjet printer according to the present invention includes the above-mentioned inkjet head, whereby miniaturization is achieved while printing with a plurality of kinds of ink can be performed.

In the head chip unit according to the present invention, the ink chambers each have the supply part, and the ink supply holes corresponding to the supply parts are formed. As a result, a plurality of kinds of ink can be discharged according to the number of the supply parts and ink supply holes to be formed, so miniaturization is achieved and printing with a plurality of kinds of ink can be performed.

Further, the method of producing the head chip unit according to the present invention includes the head chip forming step and the ink supply hole forming step, thereby enabling production of a small-size head chip capable of printing with a plurality of kinds of ink.

Further, the inkjet head according to the present invention includes the above-mentioned head chip unit, whereby the size and manufacturing costs of the inkjet head can be reduced and printing with a plurality of kinds of ink can be performed.

Further, the inkjet printer according to the present invention includes the above-mentioned inkjet head, whereby the size and manufacturing costs of the inkjet head can be reduced and printing with a plurality of kinds of ink can be performed with low cost.

DETAILED DESCRIPTION OF THE PREFERRED EMBODIMENTS

First Embodiment

Figure 1:
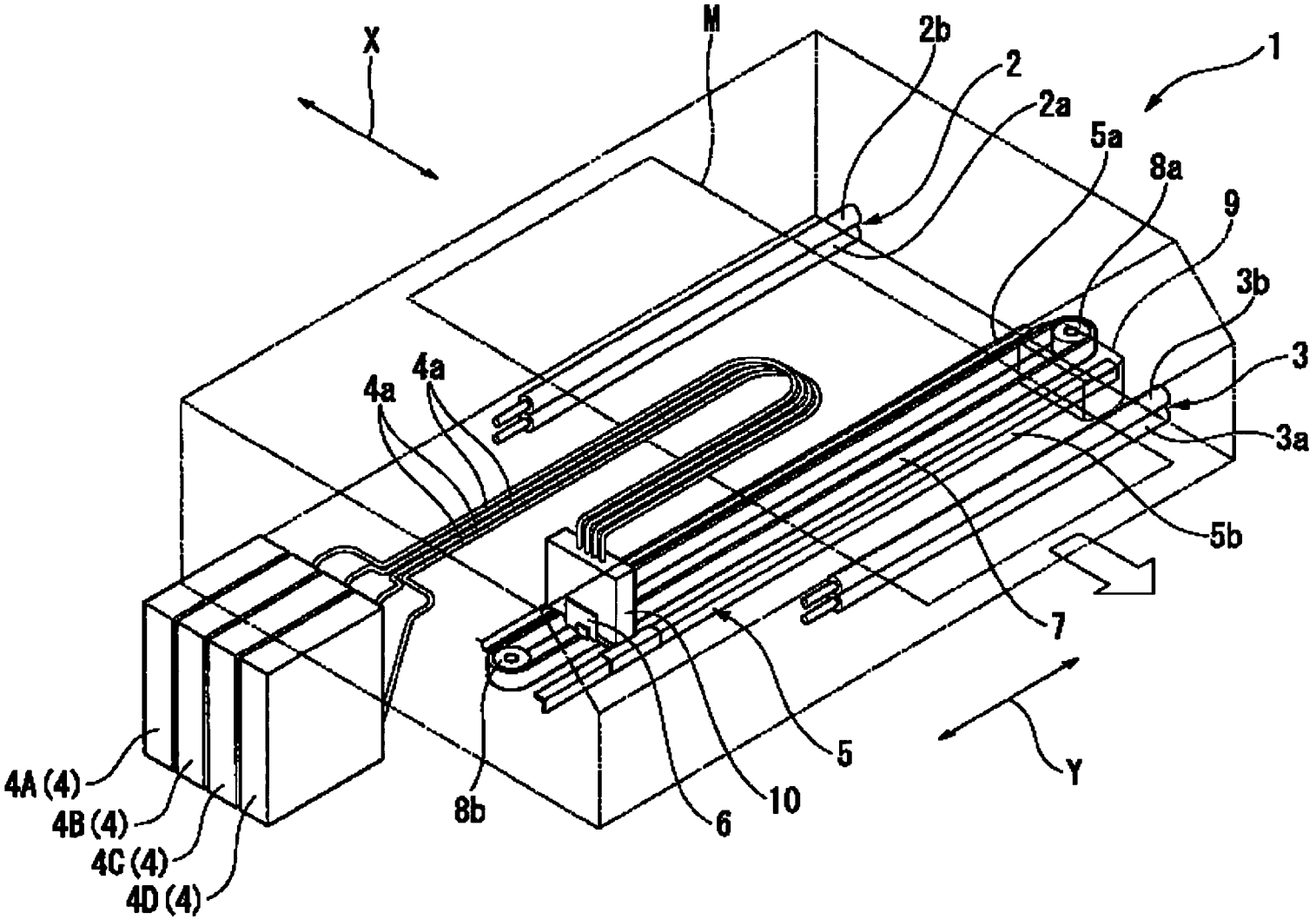
FIG. 1 is a perspective view showing an outline of an inkjet printer according to a first embodiment of the present invention.

FIGS. 1 to 15 each show an embodiment of the present invention. As shown in FIG. 1, an inkjet printer 1 according to a first embodiment of the present invention includes: a pair of transport means 2 and 3 for transporting a medium M such as paper in a transport direction X; an inkjet head 10 for discharging ink onto the medium M; ink tanks 4 for supplying ink to the inkjet head 10; and scanning means 5 for scanning the inkjet head 10 in a width direction Y substantially orthogonal to the transport direction X. The pair of transport means 2 and 3 are formed of a grid roller 2*a* and a pinch roller 2*b*, and a grid roller 3*a* and a pinch roller 3*b*, respectively. The grid rollers 2*a* and 3*a* are rotated by a drive motor (not shown), thereby enabling transportation of the medium M pinched between the pinch rollers 2*b* and 3*b* in the transport direction X. The scanning means 5 includes a pair of guide rails 5*a* and 5*b* arranged in the width direction Y, and a carriage 6 which is slidable on the pair of guide rails 5*a* and 5*b* in the width direction Y and has the inkjet head 10 mounted thereto. In addition, between the pair of guide rails 5*a* and 5*b*, a timing belt 7 to which the carriage 6 is fixed is disposed in the width direction Y and is wound around a pair of pulleys 8*a* and 8*b* at both ends. The pulley 8*a* is coupled to a carriage drive motor 9, and the carriage drive motor 9 is driven to rotate the pulley 8*a*, thereby running the timing belt 7 in the width direction Y so as to advance and retract the carriage 6 in the width direction Y.

In the first embodiment of the present invention, as the ink tanks 4, there are mounted four ink tanks 4A, 4B, 4C, and 4D which are filled with different kinds of ink so as to be capable of performing printing in four kinds of ink of yellow, magenta, cyan, and black. Note that, in the first embodiment of the present invention, the ink filled in each of the ink tanks 4 is described as aqueous ink. The ink tanks 4 are each connected to the inkjet head 10, which is mounted to the carriage 6, via pipings 4*a*, thereby enabling supply of the four kinds of ink to the inkjet head 10. In addition, the pipings 4*a* each have flexibility so as to be capable of following the movement of the carriage 6.

Figure 2:
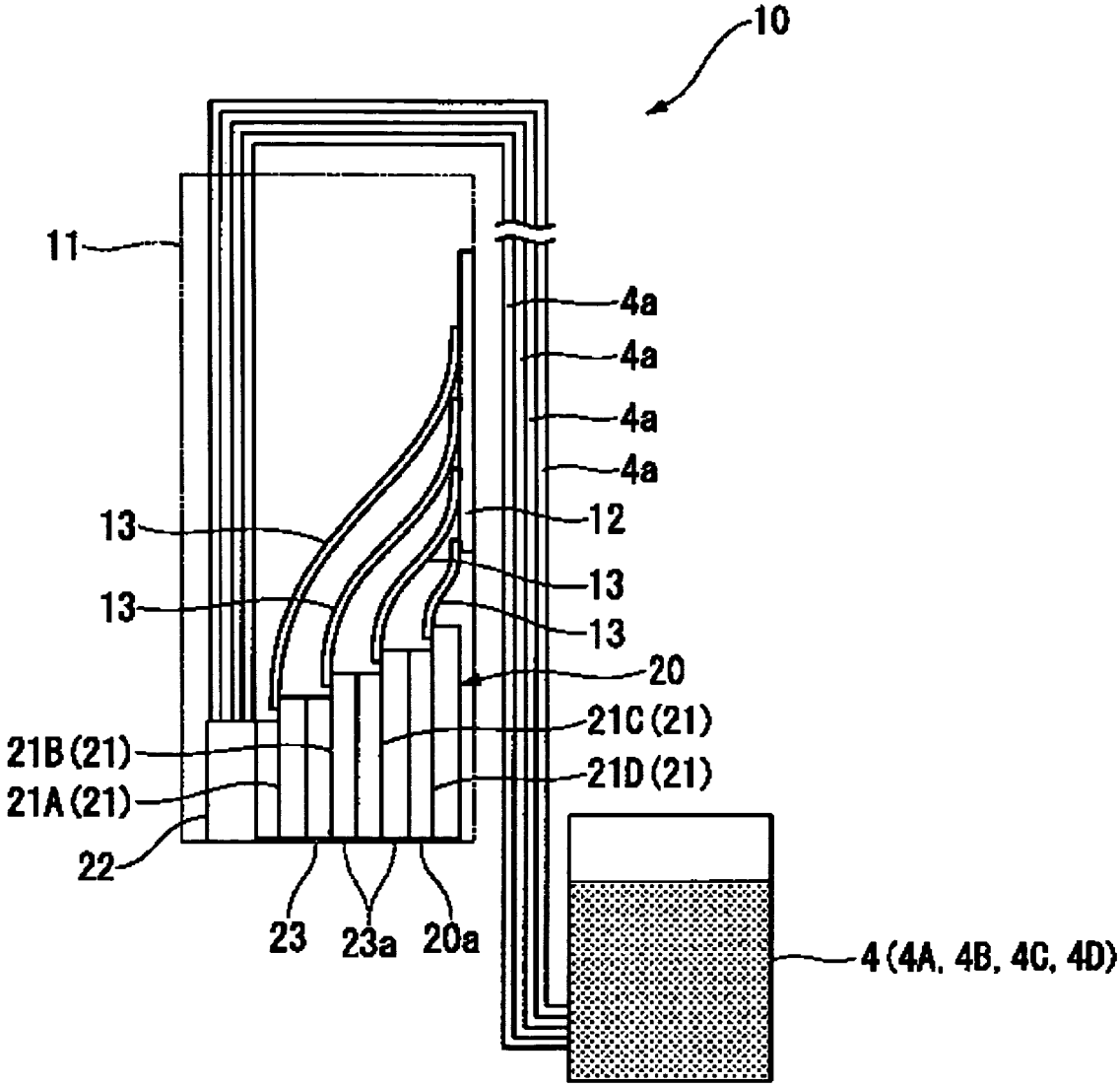
FIG. 2 is a side view showing the outline of the inkjet head according to the first embodiment of the present invention.

As shown in FIG. 2, the inkjet head 10 includes: an outer casing 11 covering a periphery of the inkjet head 10; a head chip unit 20 contained in the outer casing 11; an IC substrate 12; and flexible printed circuit boards (hereinafter, referred to as "FPC") 13. The head chip unit 20 is connected to each of the ink tanks 4 via the corresponding pipings 4*a*, and a discharge surface 20*a* is allowed to expose from the outer casing 11. In addition, a part of the IC substrate 12 is exposed from the outer casing 11 so as to be capable of being electrically connected to an outside, and is connected to a control part (not shown) in a state of being mounted to the carriage 6. The FPCs 13 each electrically connect, as a wiring board, the head chip unit 20 to the IC substrate 12. In the first embodiment of the present invention, four FPCs 13 are connected so as to correspond to the number of layers of head chips 21 to be described later. Further, in response to electrical signals to be input from the IC substrate 12 via the FPCs 13, the head chip unit 20 can discharge ink supplied from each of the ink tanks 4 from the discharge surface 20*a*. Hereinafter, the head chip unit 20 will be described in detail.

Figure 3:
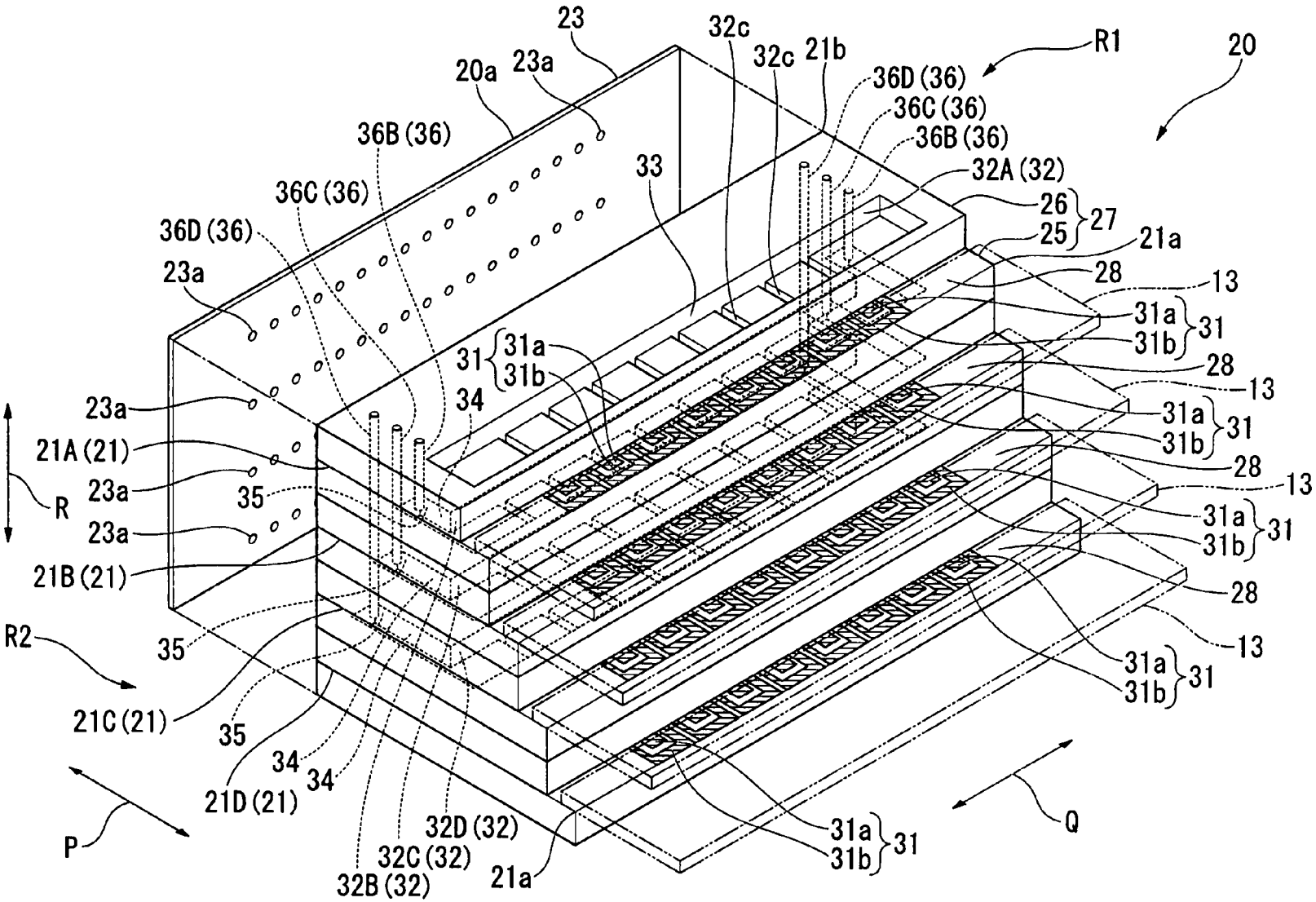
FIG. 3 is an exploded perspective view showing a head chip unit according to the first embodiment of the present invention.
Figure 4:
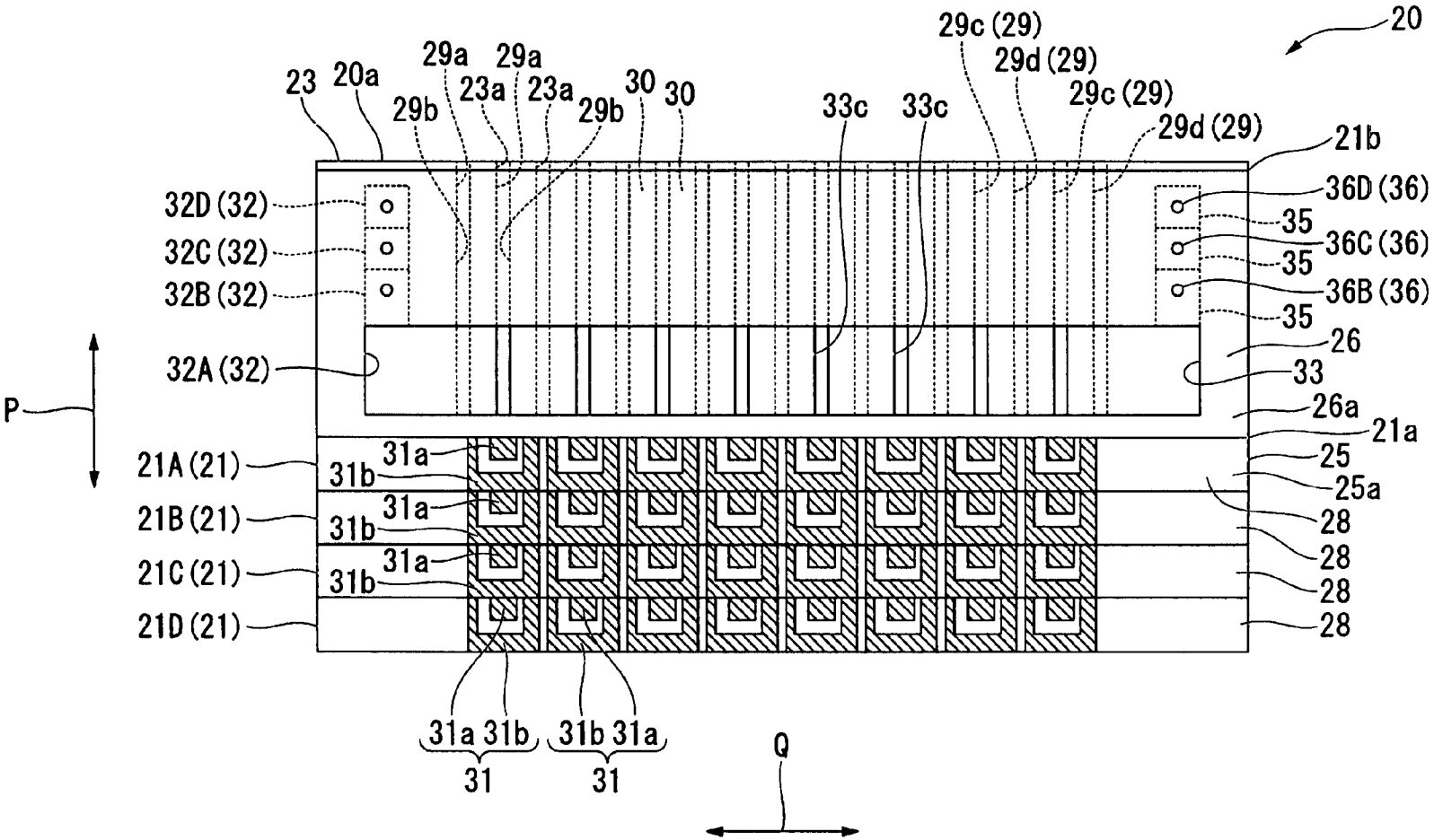
FIG. 4 is a top view showing the head chip unit according to the first embodiment of the present invention.
Figure 5:
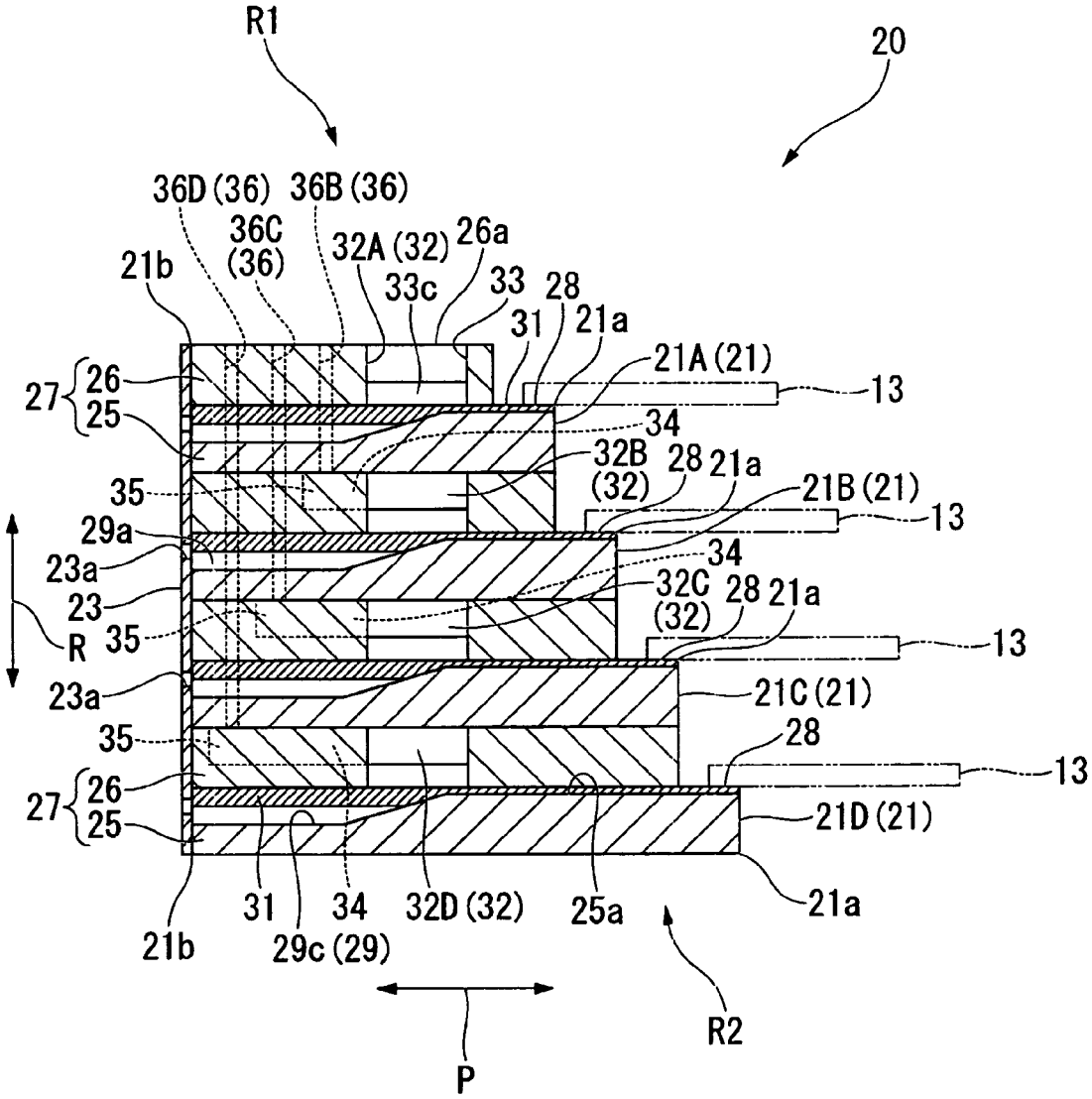
FIG. 5 is a cross-sectional diagram showing the head chip unit according to the first embodiment of the present invention.
Figure 6A:
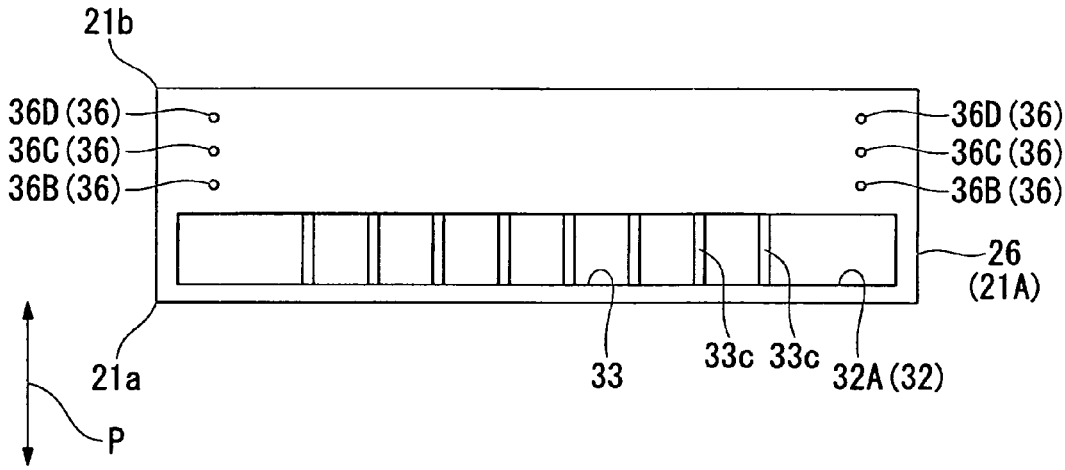
FIGS. 6A and 6B are top views each showing a substrate of one head chip in the head chip unit according to the first embodiment of the present invention.
Figure 6B:
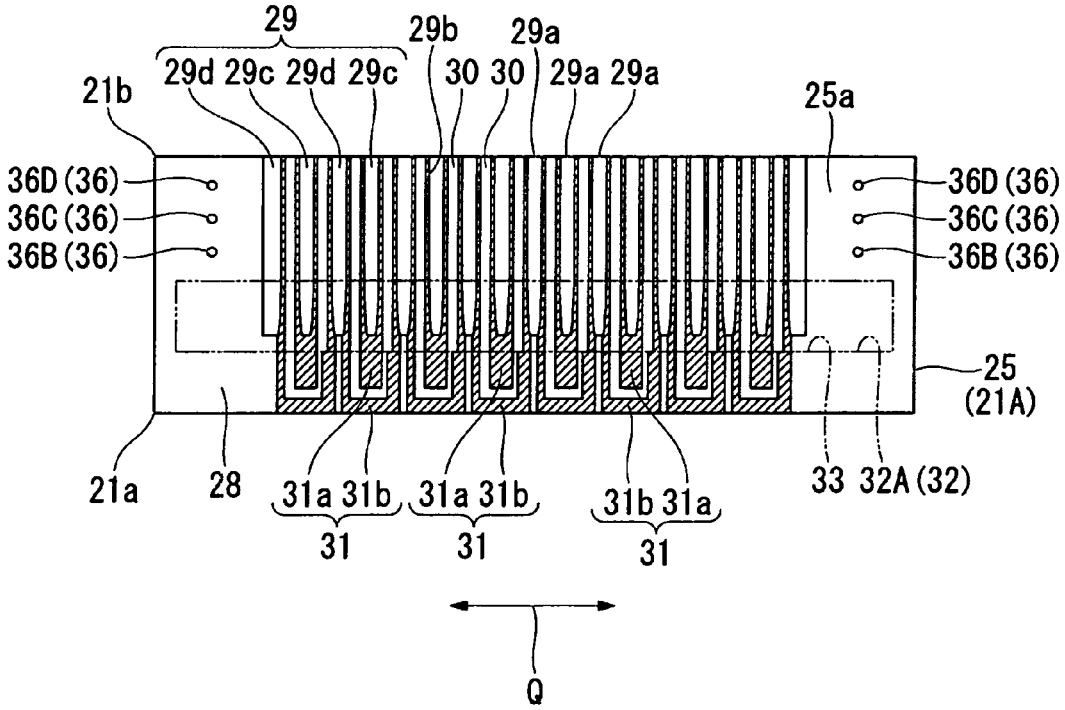
Figure 7A:
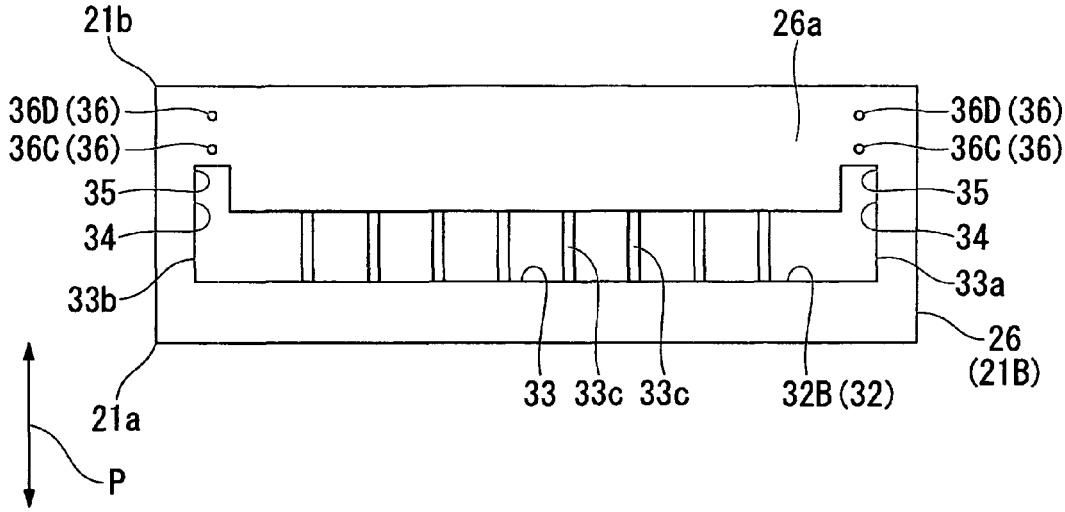
FIGS. 7A and 7B are top views each showing a substrate of another head chip in the head chip unit according to the first embodiment of the present invention.
Figure 7B:
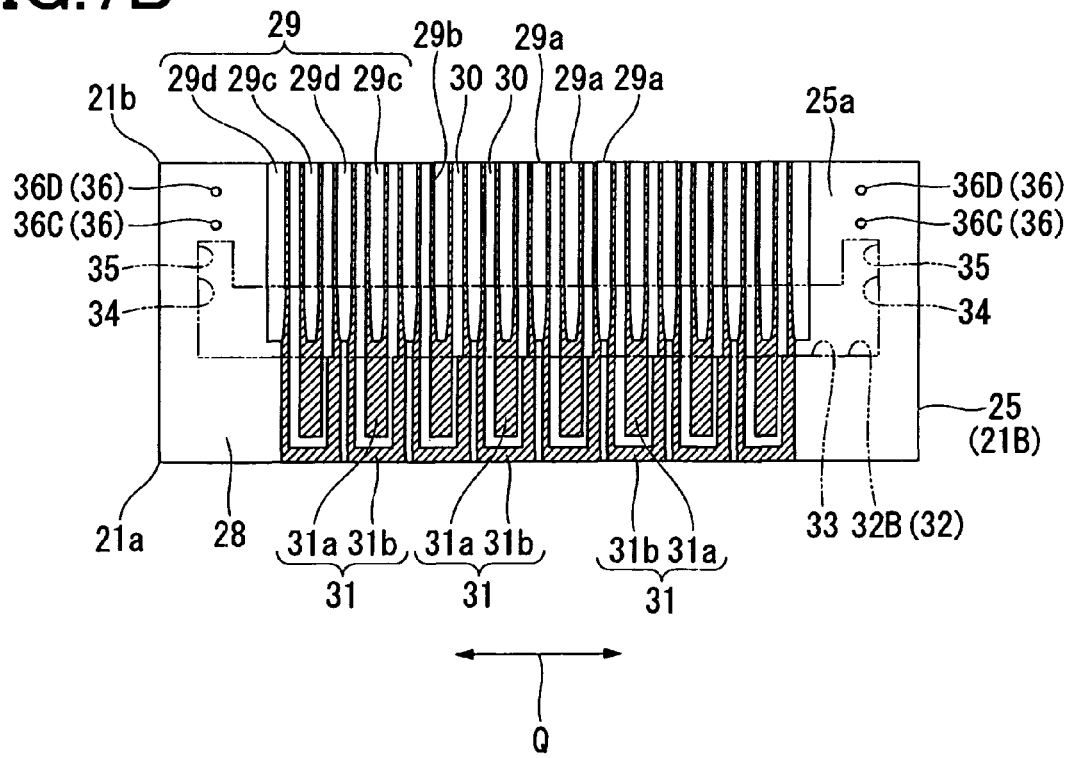
Figure 8A:
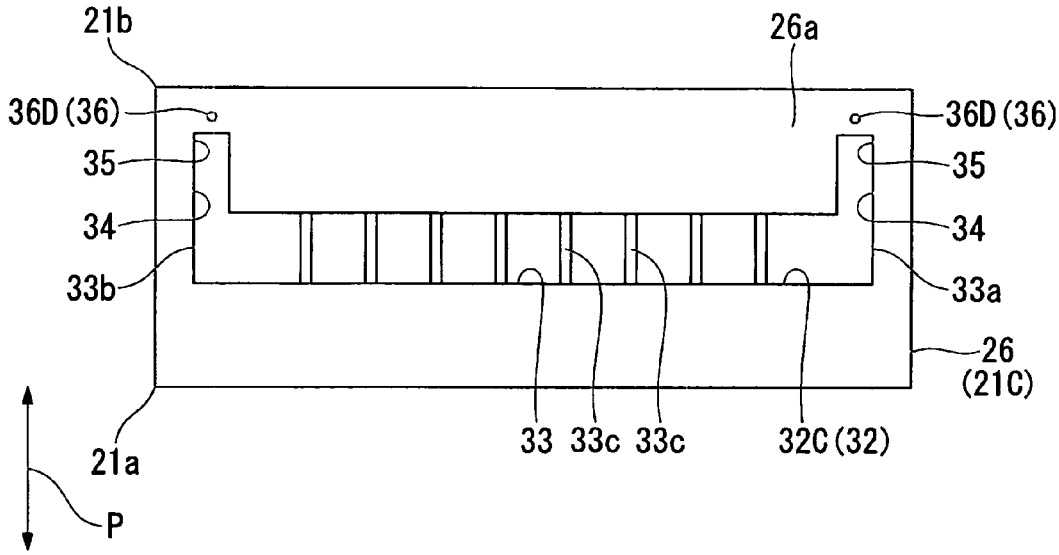
FIGS. 8A and 8B are top views each showing a substrate of another head chip in the head chip unit according to the first embodiment of the present invention.
Figure 8B:
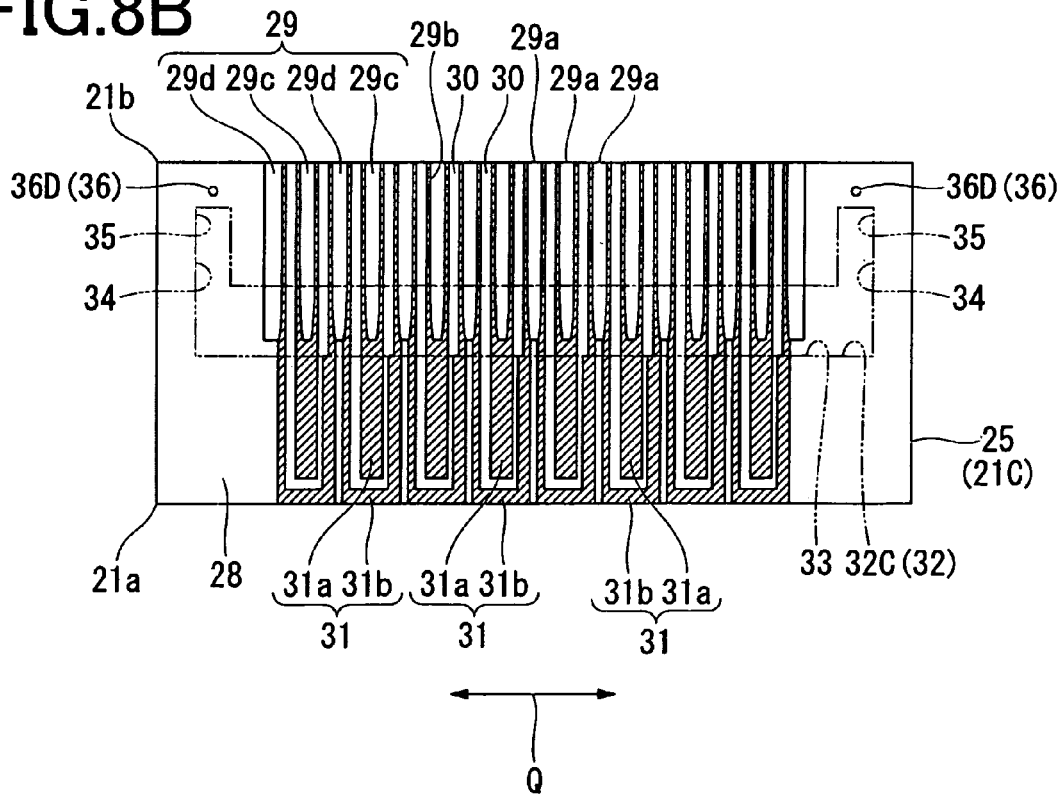
Figure 9A:
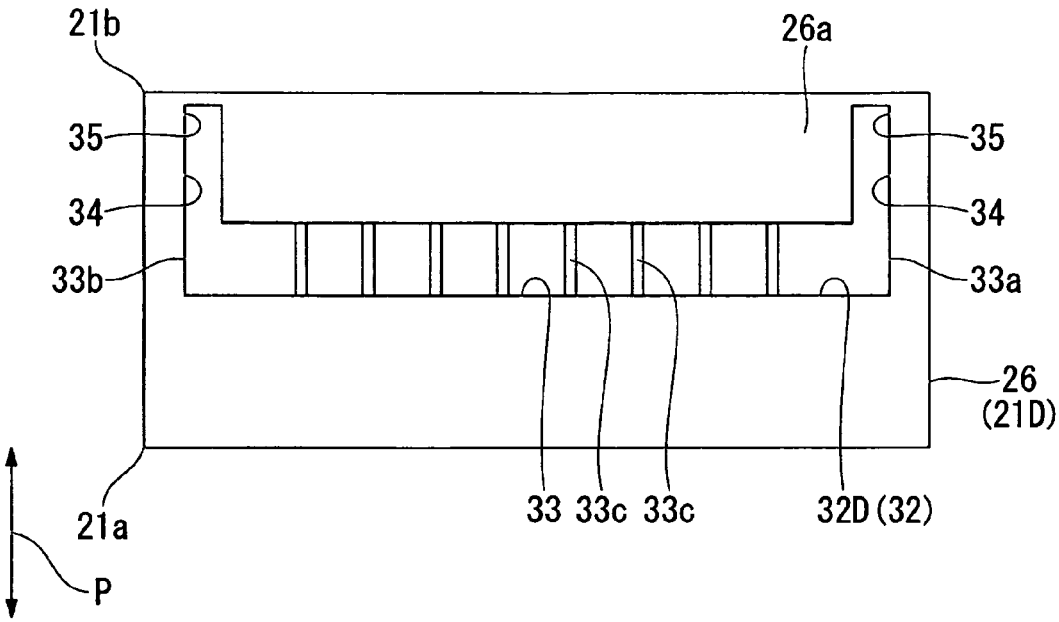
FIGS. 9A and 9B are top views each showing a substrate of another head chip in the head chip unit according to the first embodiment of the present invention.
Figure 9B:
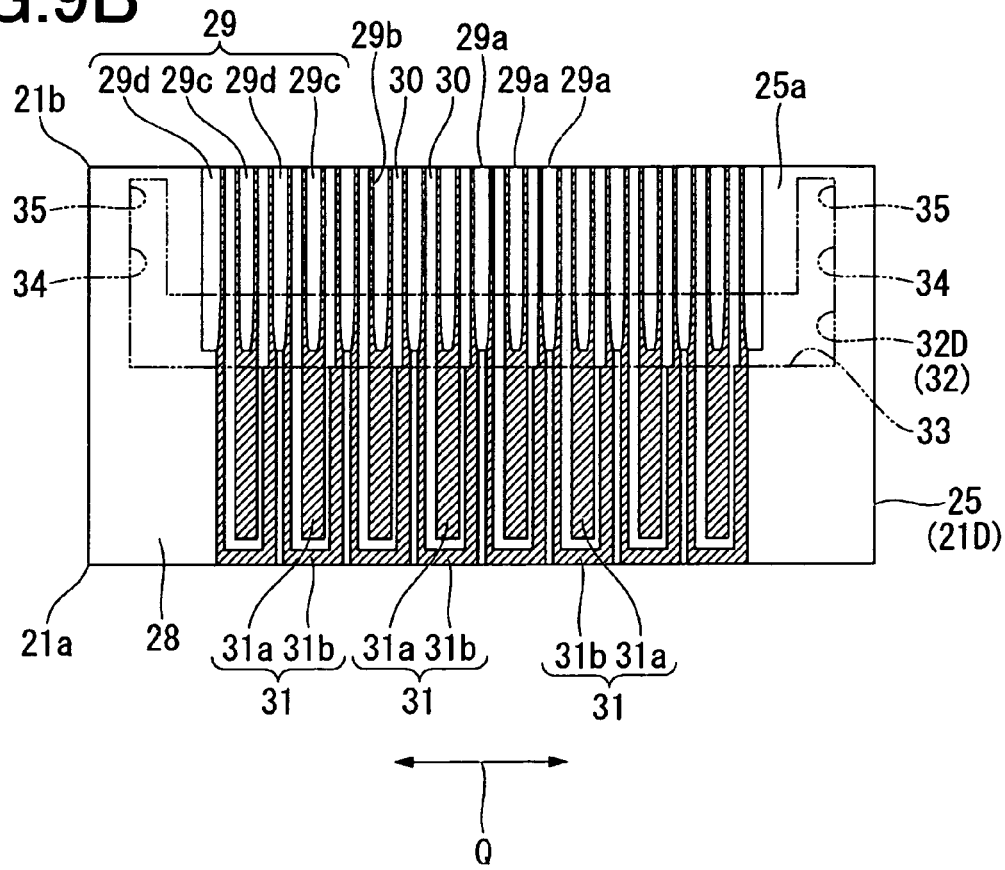

As shown in FIG. 2, the head chip unit 20 includes: the head chips 21 laminated in a plurality of layers; a head cover 22 for connecting the head chips 21 to the pipings 4*a*; and a nozzle plate 23 having the discharge surface 20*a* formed thereon and having nozzle holes 23*a*. As shown in FIGS. 3 to 5, the head chips 21 are laminated in four layers, that is, head chips 21A, 21B, 21C, and 21D so as to correspond to the kinds of ink. The head chips 21 are laminated so as to be stepwise on a side of one edge 21*a* and so as to be aligned with each other on a side of another edge 21*b* so that the nozzle plate 23 can be joined thereto. The head chips 21 are each formed of a substantially plate-like head chip main body 27 in which a cover plate substrate 26 is laminated on one surface 25*a* of an actuator substrate 25. In this case, FIG. 6A is a top view of the cover plate substrate of the head chip 21A, and FIG. 6B shows a top view of the actuator substrate of the head chip 21A. In a similar manner, FIGS. 7A and 7B are top views respectively showing the cover plate substrate and the actuator substrate of the head chip 21B, FIGS. 8A and 8B are top views respectively showing the cover plate substrate and the actuator substrate of the head chip 21C, and FIGS. 9A and 9B are top views respectively showing the cover plate substrate and the actuator substrate of the head chip 21D.

As shown in FIGS. 3 to 9B, in each of the head chips 21, the actuator substrate 25 is formed of a substantially plate-like member made of piezoceramic and has a substrate connecting surface 28 on which the FPC 13 is connected to the one surface 25*a* on the one edge 21*a* side. In addition, in the actuator substrate 25, on the side of the another edge 21*b* of the substrate connecting surface 28, there are provided a plurality of channels 29 each formed in a groove shape opened in the one surface 25*a*. The plurality of channels 29 are each formed so as to extend in a supply direction P from the one edge 21*a* to the another edge 21*b*, and are each opened with an opening 29*a* at the another edge 21*b*. In addition, the plurality of channels 29 are arranged in an arrangement direction Q substantially orthogonal to the supply direction P with side walls 30 formed between the plurality of channels 29. In this case, in the plurality of head chips 21, the plurality of channels 29 each have substantially the same cross-sectional shape and length. In addition, on wall surfaces 29*b* of the plurality of channels 29, there are formed electrodes 31 each extending to the substrate connecting surface 28. The electrodes 31 are each formed of a common electrode 31*a* and a drive electrode 31*b*. As described later, the common electrodes 31*a* are formed so as to correspond to common grooves 29*c* alternately set in the plurality of channels 29. In other words, the common electrodes 31*a* are each formed in a substantial I-shape on the substrate connecting surface 28 on a proximal end side of each of the common grooves 29*c*, and are each branched and formed to both wall surfaces 29*b* of the corresponding common grooves 29*c*. In addition, the drive electrodes 31*b* are formed so as to correspond to active grooves 29*d* each formed between the common grooves 29*c*. In other words, the drive electrodes 31*b* are each formed in a substantial U-shape so as to extend to the adjacent active grooves 29*d* at both sides thereof across the common electrode 31*a*. The drive electrodes 31*b* extending to the active grooves 29*d* are each continuously formed to the wall surfaces 29*b* on the sides adjacent to the corresponding common grooves 29*c*.

Further, in each of the head chips 21, the cover plate substrate 26 is formed of a substantial plate-like member made of ceramic or metal. In view of deformation of the cover plate substrate 26 after being coupled to the actuator substrate 25, it is preferable that the cover plate substrate 26 be made of ceramic which has substantially the same coefficient of thermal expansion. The cover plate substrate 26 is laminated on the one surface 25*a* of the actuator substrate 25 so that the another edge 21*b* side of the cover plate substrate 26 is formed at substantially the same position as that of the actuator substrate 25 and so that the substrate connecting surface 28 formed on the actuator substrate 25 is allowed to project to the one edge 21*a* side.

Further, as shown in FIGS. 5 to 9B, on the cover plate substrate 26, an ink chamber 32 opened in one surface 26*a* is formed. In the head chips 21 (21A, 21B, 21C, and 21D), the corresponding ink chambers 32 (32A, 32B, 32C, and 32D) each have a main body part 33 formed in the arrangement direction Q at a position corresponding to the one edge 21*a* side of the plurality of channels 29. In addition, in the head chips 21B, 21C, and 21D other than the head chip 21A laminated on a surface closest to one side. R1, the ink chambers 32 (32B, 32C, and 32D) each include introduction parts 34 formed in the supply direction P from both end parts 33*a* and 33*b* of the main body part 33, and supply parts 35 formed at each end of the introduction parts 34. In a state where the head chips 21 are laminated, the main body parts 33 of the plurality of head chips 21 are formed at substantially the same position in the supply direction P with the another edge 21*b* as a reference. The main body parts 33 are formed in the arrangement direction Q at positions where the both end parts 33*a* and 33*b* are not overlapped with the plurality of channels 29, which are arranged in the arrangement direction Q, in a laminating direction R. Thus, the introduction parts 34 each connected to the main body part 33 at the both end parts 33*a* and 33*b* are formed in the supply direction P substantially in parallel with the plurality of channels 29 toward the another edge 21*b* side at positions where the introduction parts 34 are not overlapped with the plurality of channels 29 in the laminating direction R. In this case, lengths of the introduction parts 34 of the head chips 21B to 21D in the supply direction P are set to be longer in an order from the head chip 21B laminated on the one side R1 to the head chip 21D laminated on an another side R2. Thus, in the ink chamber 32, the supply parts 35 formed at each end of the introduction parts 34 are formed at positions where the supply parts 35 are not overlapped, in the laminating direction R, with the plurality of channels 29 and the ink chamber 32 of another head chip 21 laminated on the one side R1 from the subject head chip 21 in which the supply parts 35 are formed. In addition, the main body part 33 of the ink chamber 32 has a plurality of through holes 33*c* formed therein, which alternately communicate with the corresponding the plurality of channels 29. Accordingly, the plurality of channels 29 of the actuator substrate 25 alternately become the common grooves 29*c* capable of supplying ink from the main body part 33 of the ink chamber 32. In addition, ink is not supplied between the common grooves 29*c*, thereby obtaining the active grooves 29*d* which merely cause a volume change.

Then, as shown in FIGS. 3 to 5, among the plurality of head chips 21, the head chips 21 laminated to be adjacent to each other are joined with each other so that a position of one edge of the cover plate substrate 26 of the head chip 21 on the another side R2 is substantially equal to a position of one edge of the actuator substrate 25 of the head chip 21 on the one side R1. As a result, the plurality of head chips 21 are laminated stepwise such that the substrate connecting surface 28 formed on each of the actuator substrates 25 is allowed to project to the one edge 21*a* side toward the one side R1 in the laminating direction R. Accordingly, on the another edge 21*b* side, the plurality of channels 29 are arranged in four rows in the laminating direction R. Note that the nozzle holes 23*a* of the nozzle plate 23 are formed in four rows in the laminating direction R so as to correspond to the common grooves 29*c* in the plurality of channels 29. Further, as shown in FIGS. 3, 4, and 6A to 9B, in each of the laminated head chips 21, ink supply holes 36 (36B, 36C, and 36D), which are opened in the head chip 21A laminated on a surface closest to the one side R1 and which communicate with the supply parts 35 of the ink chambers 32 (32B, 32C, and 32D), are each formed to be penetrated in the laminating direction R.

Figure 10:
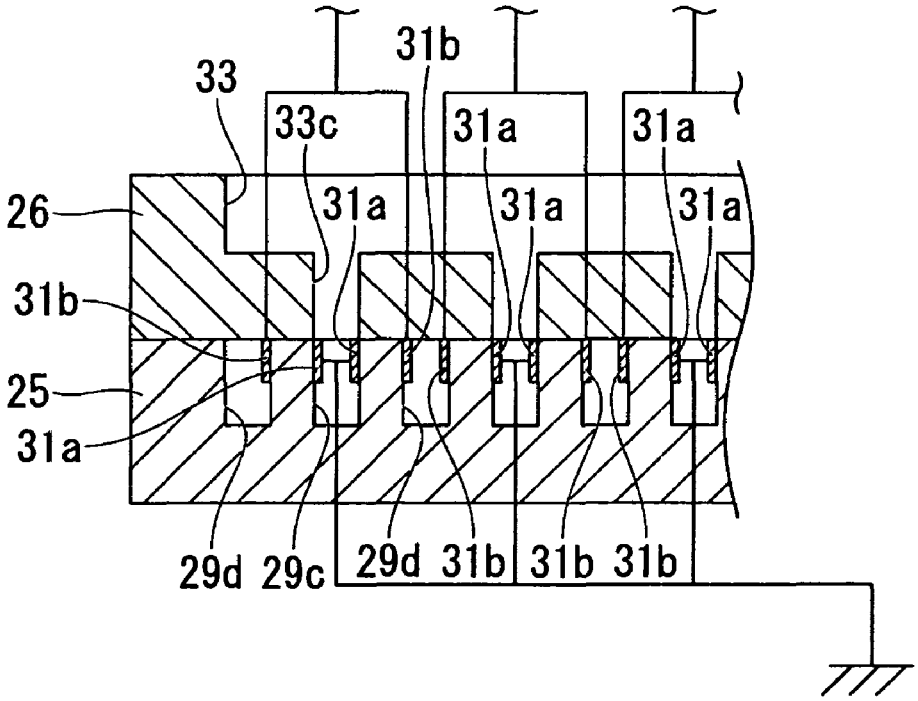
FIG. 10 is a schematic diagram showing electrode wirings in the head chip unit according to the first embodiment of the present invention.

Then, as shown in FIG. 2, the four pipings 4*a* each connected to the head cover 22 from the ink tanks 4 are respectively connected to the main body part 33 of the ink chamber 32A and the ink supply holes 36B, 36C, and 36D in the head chip 21A laminated on the surface closest to the one side R1. In other words, for example, it is assumed that the ink tank 4A filled with yellow ink is connected to the main body 33 of the ink chamber 32A, the ink tank 4B filled with magenta ink is connected to the ink supply hole 36B, the ink tank 4C filled with cyan ink is connected to the ink supply hole 36C, and the ink tank 4D filled with black ink is connected to the ink supply hole 36D. In this case, the yellow ink supplied to the main body part 33 of the ink chamber 32A is supplied to each of the common grooves 29*c* of the head chip 21A, which communicates with the ink chamber 32A, in the plurality of channels 29. By the FPC 13 connected to the substrate connecting surface 28, the common electrodes 31*a* are grounded with wirings as shown in FIG. 10, and a voltage is applied to each of the drive electrodes 31*b* independently with a predetermined pattern, thereby making it possible to continuously change a volume of an inside of each of the plurality of channels 29. As a result, the yellow ink supplied in each of the common grooves 29*c* can be discharged to the outside through the nozzle holes 23*a* of the nozzle plate 23 from the openings 29*a* of the head chip 21A. The cyan ink supplied to the ink supply hole 36B is supplied to the main body part 33 via the introduction parts 34 from the supply parts 35 in the ink chamber 32B of the head chip 21B. Then in a similar manner, the cyan ink can be discharged to the outside via the nozzle holes 23*a* of the nozzle plate 23 from the openings 29*a* of the head chip 21B. In addition, the magenta ink supplied to the ink supply hole 36C can be discharged to the outside from the openings 29*a* of the head chip 21C, and the black ink supplied to the ink supply hole 36D can be discharged to the outside from the openings 29*a* of the head chip 21D. In other words, in a single head chip unit 20, the ink of four colors, that is, yellow, cyan, magenta, and black can be simultaneously discharged from the plurality of channels 29 in each row. In this case, the plurality of channels 29 of each of the head chips 21 have substantially the same cross-sectional shape and length, with the result that the ink can be discharged from the plurality of channels 29 in four rows with the same discharge performance for each color.

Next, a description is given of the head chip unit 20 and a production method for the inkjet head 10 including the head chip unit 20 with reference to FIGS. 11 to 15. First, as a head chip forming step, the head chip main body 27, which forms each of the head chips 21, is processed, thereby forming the substrate connecting surface 28, the plurality of channels 29, the electrodes 31, and the ink chamber 32. Specifically, as an actuator substrate forming step, the plurality of channels 29 are formed through a dicing process or the like on the actuator substrate 25 in the head chip main body 27. Then, in a range from the substrate connecting surface 28 on the one surface 25*a* of the actuator substrate 25 to the wall surfaces 29*b* of the plurality of channels 29, metal films serving as the electrodes 31 are formed with a predetermined pattern by deposition or the like. Further, as a cover plate substrate forming step, the ink chamber 32 is similarly formed in the cover plate substrate 26 through a dicing process or the like. Note that, as described above, the plurality of channels 29 of the head chips 21 in each layer are formed with substantially the same cross-sectional shape and length, and the ink chambers are formed such that the main body parts 33 of the ink chambers 32 with the another edge as a reference are formed at substantially the same positions.

Figure 11:
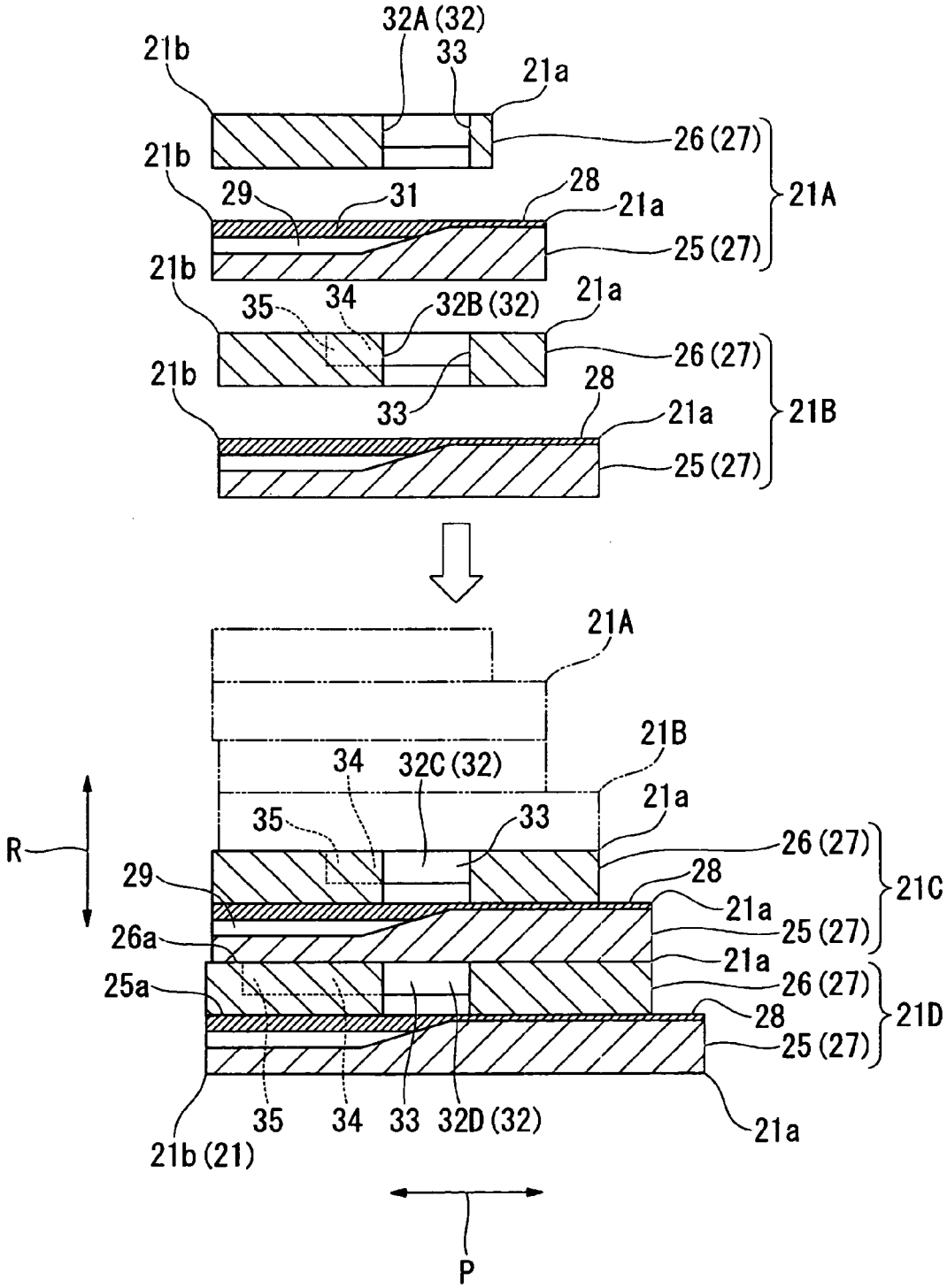
FIG. 11 is an explanatory diagram showing a lamination step in a production process for the head chip unit according to the first embodiment of the present invention.

Then, as a lamination step, as shown in FIG. 11, the actuator substrate 25 and the cover plate substrate 26, which form each of the head chips 21, are laminated on each other. First, the actuator substrate 25 forming the head chip 21D which projects to the side closest to the one edge 21*a*, is joined with the cover plate substrate 26. In this case, the both substrates are joined with each other by setting the another edge 21*b* side of each of the substrates to substantially the same position. As a result, the substrate connecting surface 28 is allowed to project to the one edge 21*a* side. Then, the adjacent actuator substrate 25 of the head chip 21C is joined to the one surface 26*a* of the cover plate substrate 26 of the head chip 21D. In this case, the both substrates are joined with each other by setting the respective another edge 21*b* sides to substantially the same positions, whereby the both substrates are joined with each other by setting the one edge 21*a* side of each of the substrates to substantially the same position. Then, the cover plate substrate 26 of the head chip 21C is joined to the one surface 25*a* of the actuator substrate 25. After that, by repeating the process, the four head chips 21A, 21B, 21C, and 21D are laminated such that the substrate connecting surfaces 28 are each allowed to project to the one edge 21*a* side stepwise, and the positions of the head chips at the another edge 21*b* are set to be substantially equal to each other. In this case, in the head chip forming step for each of the head chips 21, the positions of the main body parts 33 of the ink chambers 32 are set to be substantially equal to each other in the supply direction P, whereby the main body parts 33 are arranged in the laminating direction R. In addition, the supply parts 35 of the ink chambers 32 are arranged at positions where the supply parts 35 are not overlapped, in the laminating direction R, with the plurality of channels 29 and the ink chambers 32 of another head chip 21 laminated on the one side R1.

Figure 12:
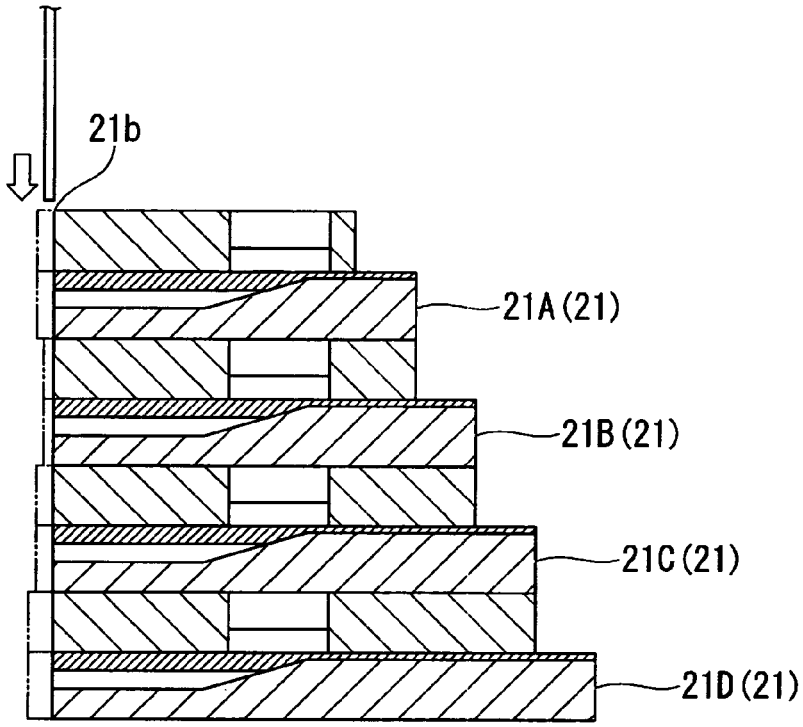
FIG. 12 is an explanatory diagram showing a nozzle plate bonded surface treatment step in the production process for the head chip unit according to the first embodiment of the present invention.
Figure 13:
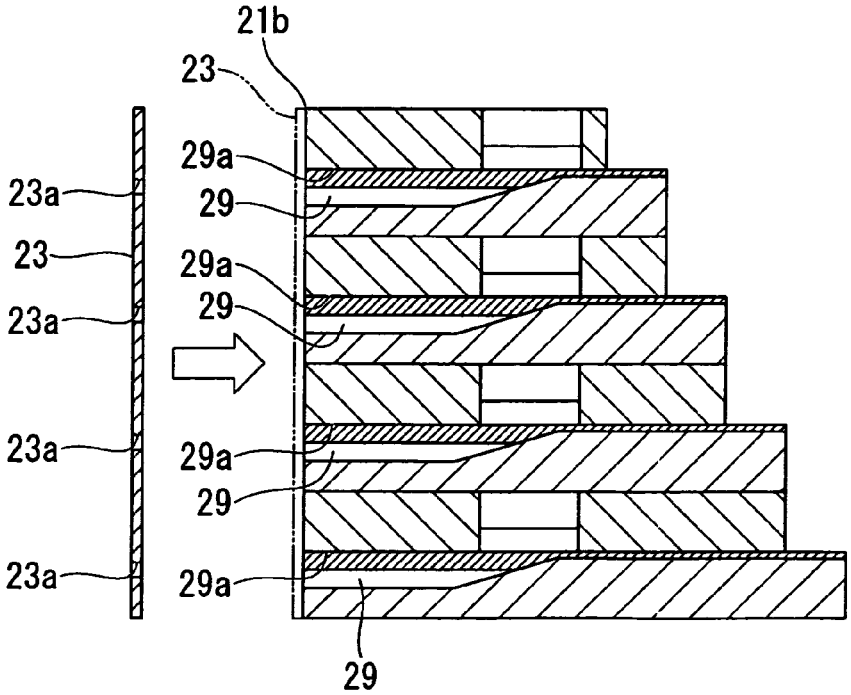
FIG. 13 is an explanatory diagram showing a nozzle plate bonding step in the production process for the head chip unit according to the first embodiment of the present invention.
Figure 14:
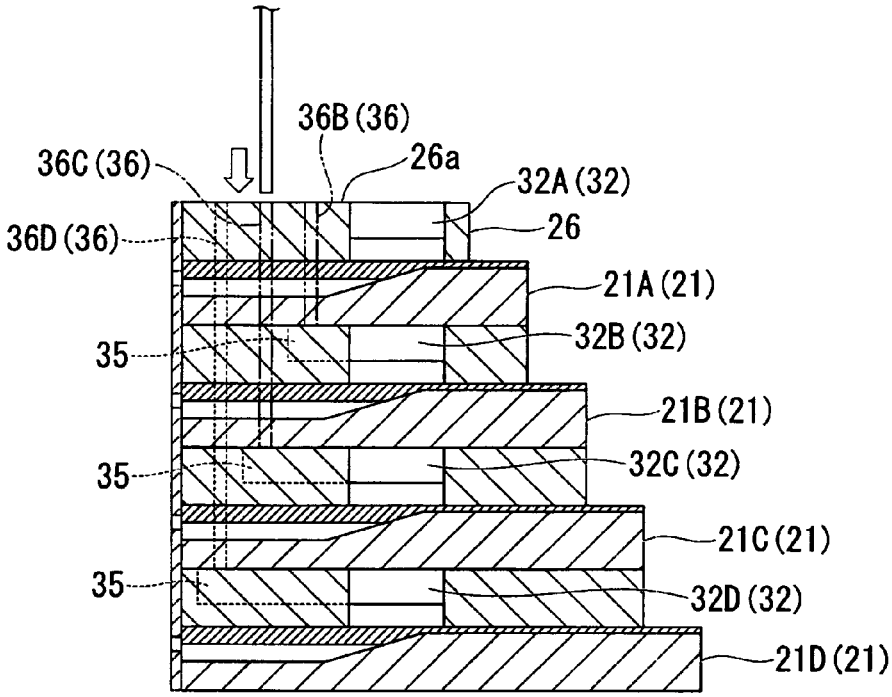
FIG. 14 an explanatory diagram showing an ink supply hole forming step in the production process for the head chip unit according to the first embodiment of the present invention.
Figure 15:
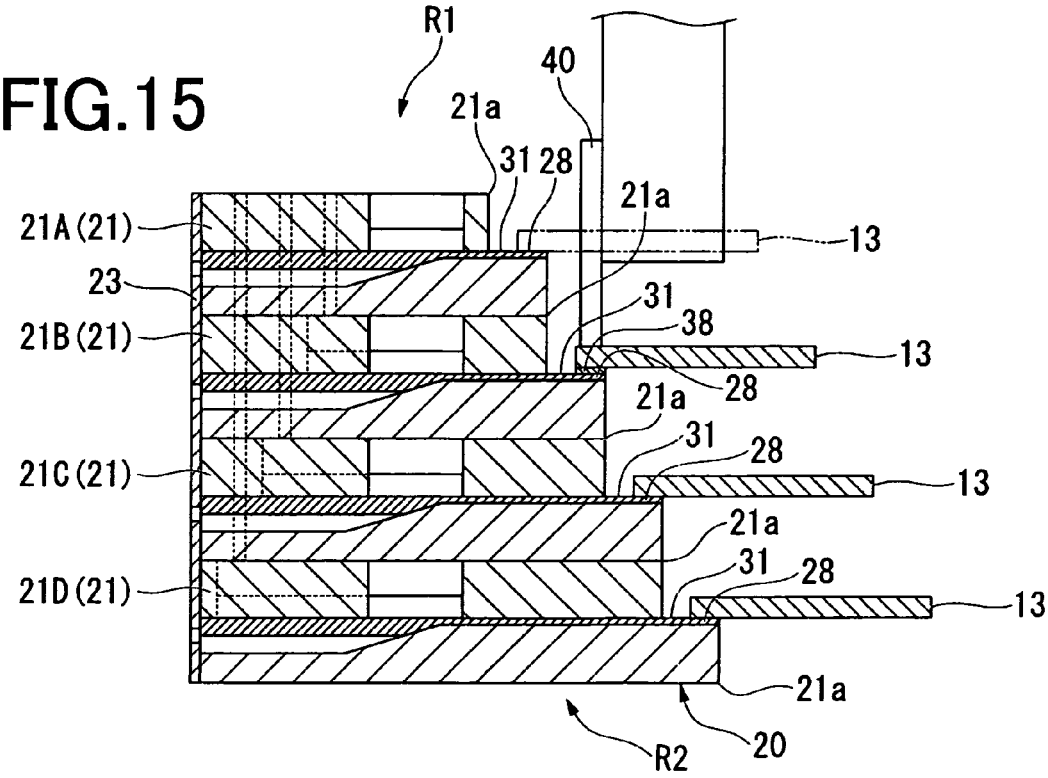
FIG. 15 is an explanatory diagram showing a wiring board connecting step in the production process for the inkjet head according to the first embodiment of the present invention.

Next, as shown in FIG. 12, as a nozzle plate bonded surface treatment step, the head chips 21 are cut at the another edge 21*b* side to which the nozzle plate 23 is to be bonded, thereby forming a flat surface. Then, as shown in FIG. 13, as a nozzle plate bonding step, the nozzle plate 23 is bonded to the another edge 21*b* side of the head chips 21. Then, as an ink supply hole forming step, the ink supply holes 36 are formed. Specifically, as shown in FIG. 14, from the one surface 26*a* of the cover plate substrate 26 of the head chip 21A on the one side R1, through holes are formed so as to reach the corresponding supply parts 35 of the ink chambers 32. Thus, the one surface 26*a* of the cover plate substrate 26 of the head chip 21A is opened, thereby forming the ink supply holes 36 (36B, 36C, and 36D) communicating with the supply parts 35 of each of the ink chambers 32. In addition, the head cover 22, which is omitted, is mounted in a similar manner, thereby producing the head chip unit 20.

Next, by the use of the head chip unit 20 thus produced, the inkjet head 10 is produced. First, as a wiring board connecting step, the FPCs 13 are connected to the head chip unit 20. Specifically, the FPCs 13 are connected to each of the substrate connecting surfaces 28 in an order from the head chip 21D, which projects to the side closest to the one edge 21*a*, toward the one side R1, among the head chips 21 forming the head chip unit 20. In other words, an anisotropic conductive film 38 is bonded to the substrate connecting surface 28, and a connecting part of the FPC 13 is brought, into contact thereon. In this state, a heat chip 40 is brought into contact with the FPC 13 from the one side R1 while being heated at about 280° C. to be pressurized. As a result, the FPC 13 is electrically connected to the electrode 31 on the substrate connecting surface 28. In this case, the head chips 21, as described above, are laminated stepwise such that the substrate connecting surfaces 28 are each allowed to project to the one edge 21*a* side. Thus, by connecting the FPC 13 to each of the substrate connecting surfaces 28 in the order from the head chip 21D having the substrate connecting surface 28 allowed to project to the side closest to the one edge 21*a*, pressurization and heating by the heat chip 40 can be performed while other head chips 21 or other FPCs 13 previously connected do not interfere with the pressurization and heating, and the FPCs 13 can be connected with ease and reliability. In addition, the head chips 21 are laminated such that the position of the one edge of the cover plate 26 of the adjacent head chip 21 is set to be substantially equal to the position of the one edge of the actuator substrate 25 of each of the head chips 21. As a result, a force acting by the heat chip 40 in the pressurization process can be reliably supported by the laminated head chips 21, and the FPCs 13 can be connected with higher reliability. Finally, the head chip unit 20 and the IC substrate 12 are accommodated in the outer casing 11, and the FPCs 13 each connected to the head chip unit 20 are connected to the IC substrate 12, thereby completing the inkjet head 10.

As described above, in the head chip unit 20 according to the first embodiment of the present invention, with respect to the head chips 21 other than the head chip 21A laminated on the surface closest to the one side R1, the supply parts 35' are formed, as a part of the ink chamber 32, at the positions where the supply parts 35 are not overlapped with the plurality of channels 29 and the ink chambers 32 of the other head chip 21 laminated on the one side R1 from the subject head chip 21 in the laminating direction R. In addition, the ink supply holes 36 opened in the head chip 21A are formed so as to communicate with the corresponding supply parts 35. As a result, to the plurality of channels 29 of each of the head chips 21, the ink different in kind from that of the other head chips 21 can be supplied from the corresponding ink supply hole 36 through the ink chamber 32, and the ink can be discharged from the openings 29*a* on the another edge 21*b* side of the plurality of channels 29. In particular, as in the first embodiment of the present invention, the head chips 21 are formed in four layers, and four sets of the supply parts 35 and of the ink supply holes 36 communicating with the supply parts 35 are provided so as to correspond to the layers. As a result, four different colors of ink can be discharged from the layers, and printing can be performed in various colors with a single head chip unit 20 according to a discharge amount of each ink.

Further, each of the ink chambers 32 includes the main body part 33 and the introduction parts 34, and the supply parts 35 are formed to the introduction parts 34. Accordingly, the width of the head chip main body 27, which forms each of the head chips 21, in the arrangement direction Q can be set to a minimum size for forming the plurality of channels 29 and the introduction parts 34 of the ink chamber 32. In addition, within a range in which the plurality of channels 29 are formed, the positions of the supply parts 35 and of the ink supply holes 26 corresponding to the supply parts 35 can be arbitrarily set in the supply direction P. For this reason, even when the plurality of head chips 21 are laminated and the multiple supply parts 35 and the ink supply holes 36 corresponding to the supply parts 35 are formed, the minimum width in the arrangement direction Q can be set without increasing the size, and a plurality of kinds of ink can be supplied and discharged.

Further, in the inkjet head 10 including the head chip unit 20, a plurality of kinds of ink can be discharged from a single head chip unit 20, thereby achieving miniaturization while enabling printing with the plurality of kinds of ink. In the inkjet printer 1, there is no need to provide a plurality of inkjet heads 10, thereby reducing the size of the entire apparatus and costs thereof, and enabling printing in the plurality of kinds of ink.

Note that, in the first embodiment of the present invention, the ink chambers 32 of the head chips 21 excluding the head chip 21A laminated on the surface closest to the one side R1 each include the supply parts 35, and are each provided with the corresponding ink supply holes 36. However, the present invention is not limited thereto. In at least one head chip 21, when the ink chamber 32 includes the supply parts 35, the ink different from that supplied to the ink chamber 32 of the head chip 21A laminated on the surface closest to the one side. R1 can be supplied. Note that, in this case, when through holes communicating with the ink chambers 32 are formed in the other head chips 21, the same kind of ink can be supplied and discharged. Further, the ink supply holes 36 are each formed on both sides of a single ink chamber 32 in the arrangement direction Q. However, the present invention is not limited thereto. Alternatively, even when the ink supply hole 36 is formed on only one side, the ink can be supplied to each of the ink chambers 32.

Further, in the lamination step, the actuator substrates 25 and the cover plate substrates 26, which form each of the head chips 21, are alternately laminated, but the present invention is not limited thereto. Alternatively, after the actuator substrate 25 and the cover plate substrate 26 are joined with each other for each head chip 21, each of the head chips 21 may be laminated. Further, the actuator substrate 25 of one head chip 21 and the cover plate substrate 26 of another head chip 21 are joined with each other so that the positions of each one edge thereof are set to be substantially equal to each other, but the present invention is not limited thereto. Alternatively, even when the cover plate 26 of the another head chip 21 projects to the one edge side, the force acting when the FPC 13 is connected to the substrate connecting surface 28 can be reliably supported. In addition, the head chip main body 27 is formed of the actuator substrate 25 and the cover plate substrate 26, but the present invention is not limited thereto. Alternatively, the head chip main body 27 may be formed of a single substrate and the substrate may be provided with the substrate connecting surface 28, the plurality of channels 29, the electrodes 31, and the ink chamber 32. Further, the ink supply hole forming step is performed after the lamination step. Alternatively, in the head chip forming step, after the through holes, which becomes the ink supply holes, are formed in each of the head chips 21, the head chips 21 may be laminated so that the through holes can communicate with each other.

Further, in the wiring board connecting step, the FPCs 13 are each connected to the substrate connecting surfaces 28 of the head chips 21 with the anisotropic conductive film 38, but the present invention is not limited thereto. For example, the FPCs 13 may be connected by wire bonding. Also in this case, the FPCs 13 can be each wire bonded onto the substrate connecting surfaces 28 with ease and reliability by using a capillary for bonding while the other head chips 21 and the other FPCs 13 do not interfere the connection. Moreover, in the first embodiment of the present invention, aqueous ink is used, but the present invention is not limited thereto. Alternatively, oil-based ink, solvent-based ink, UV-based ink, and the like may be used.

Figure 16:
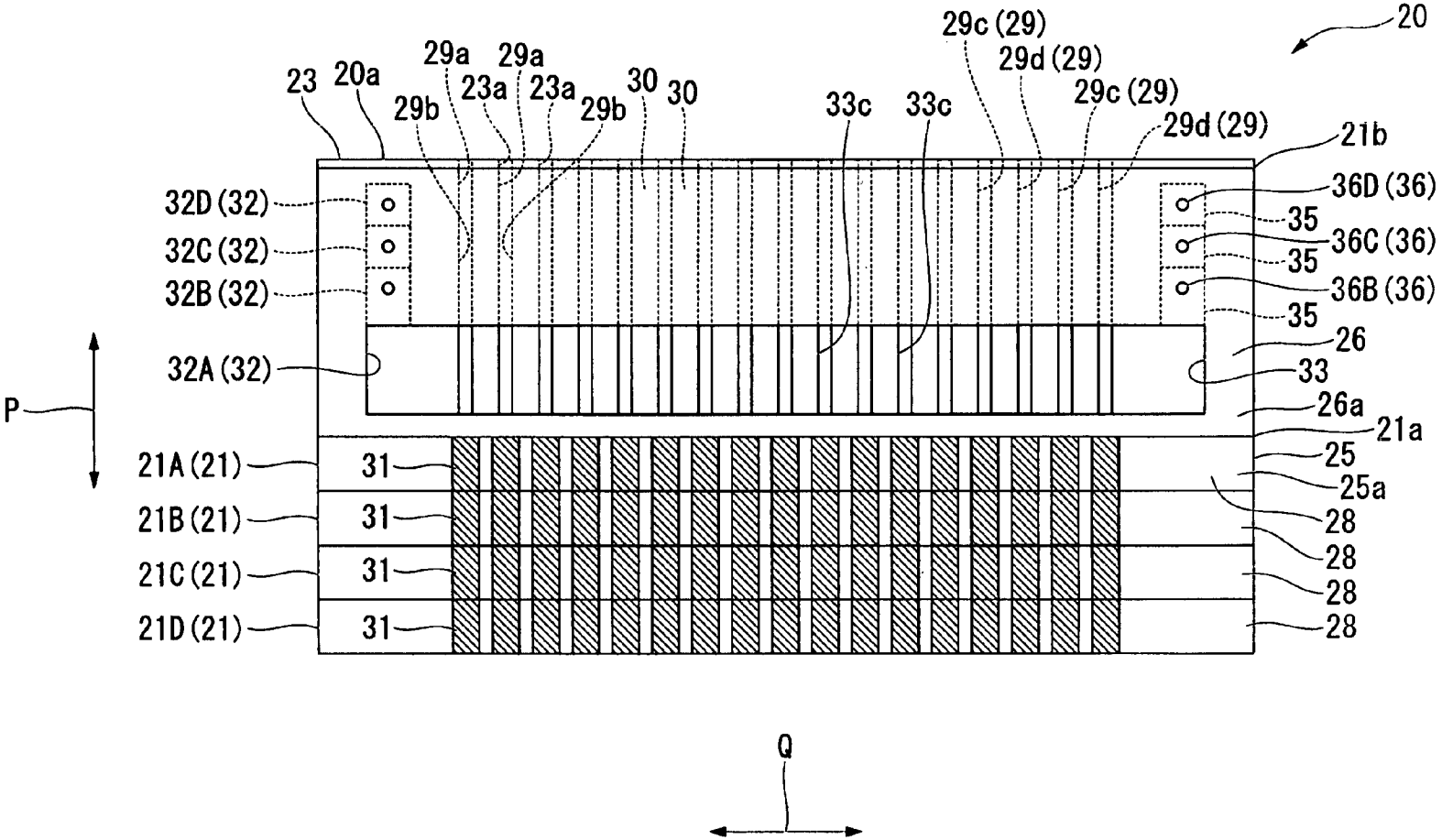
FIG. 16 is a top view showing a modified example of the head chip unit according to the first embodiment of the present invention.
Figure 17:
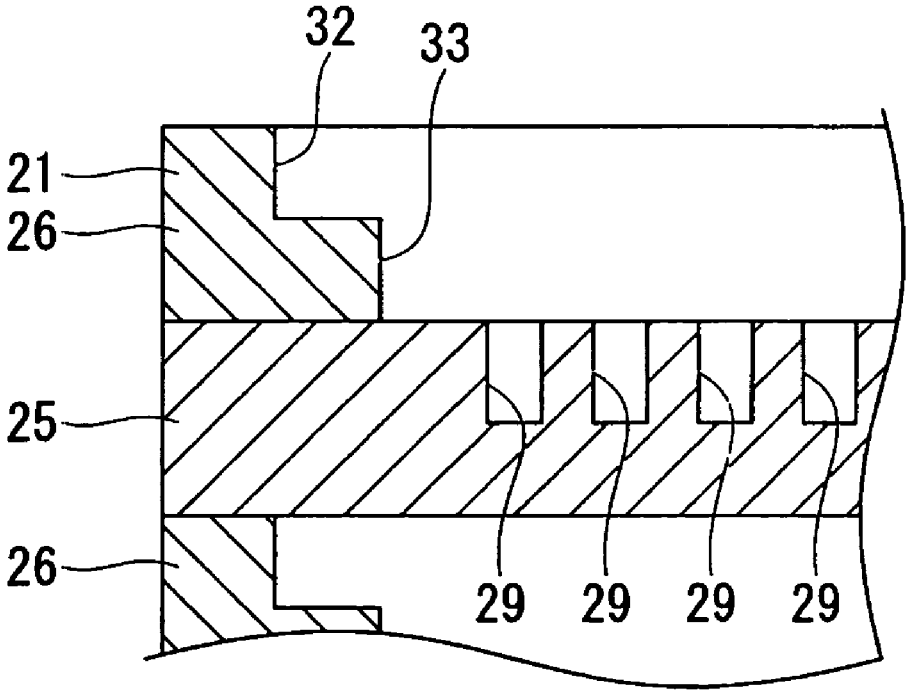
FIG. 17 is a partially enlarged cross-sectional diagram showing the modified example of the head chip unit according to the first embodiment of the present invention.
Figure 18:
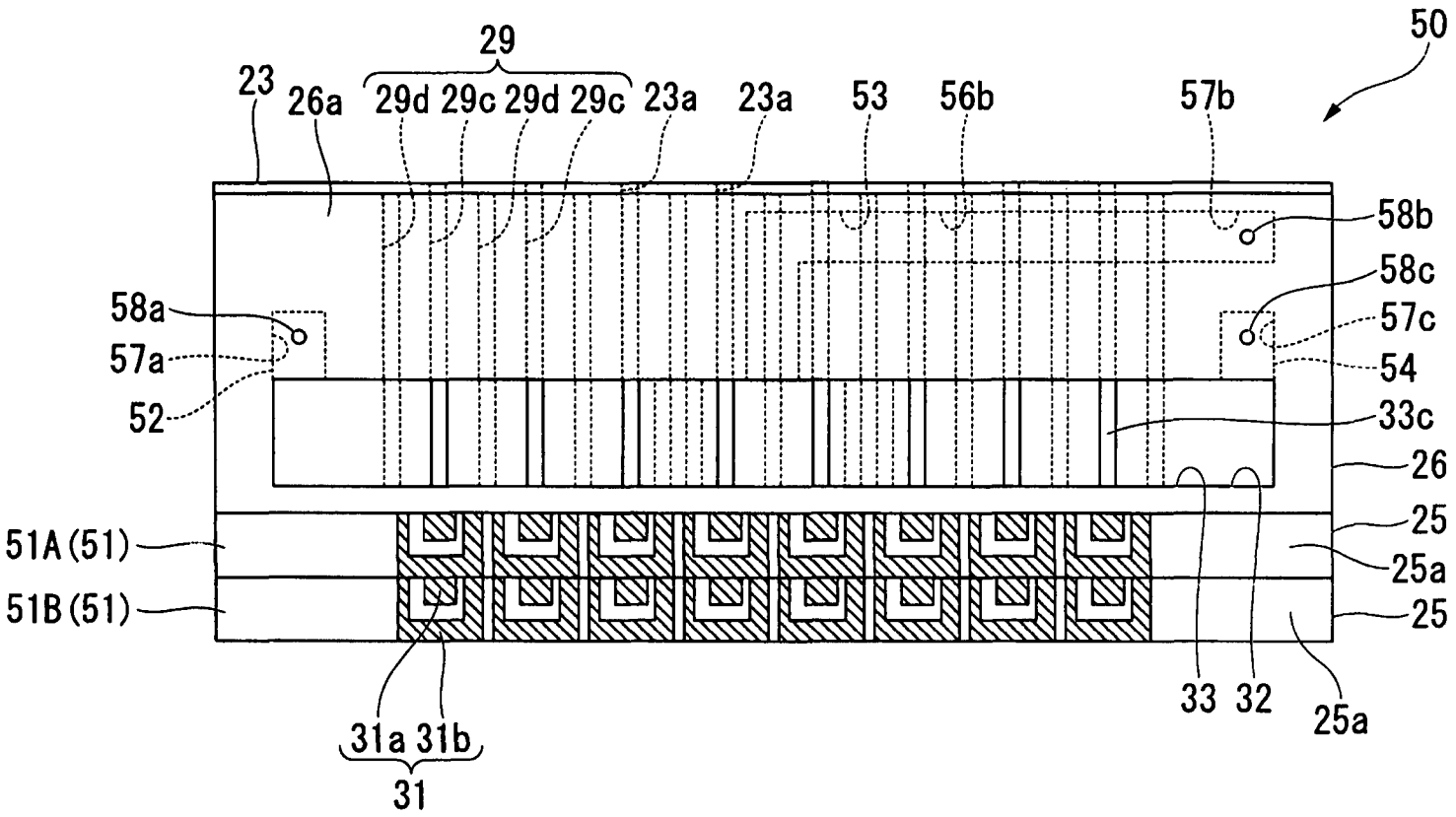
FIG. 18 is a top view showing a head chip unit according to a second embodiment of the present invention.
Figure 19A:
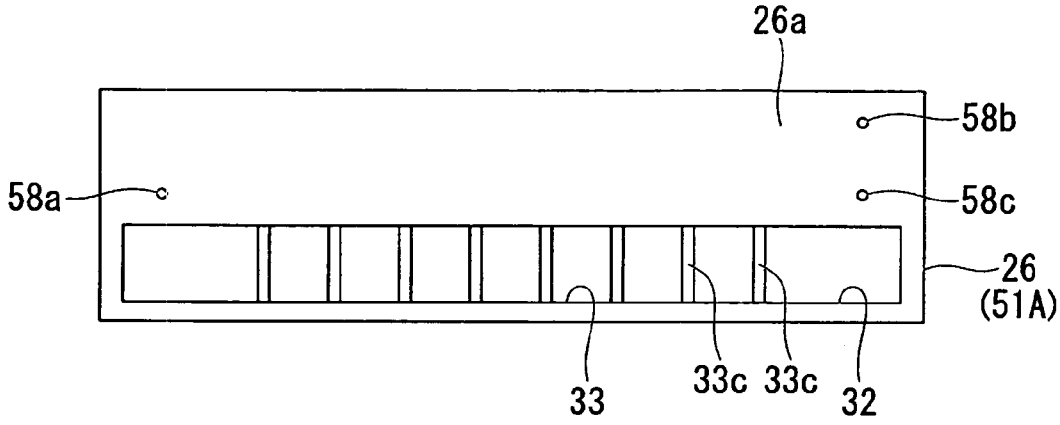
FIGS. 19A and 19B are top views each showing a substrate of one head chip in the head chip unit according to the second embodiment of the present invention.
Figure 19B:
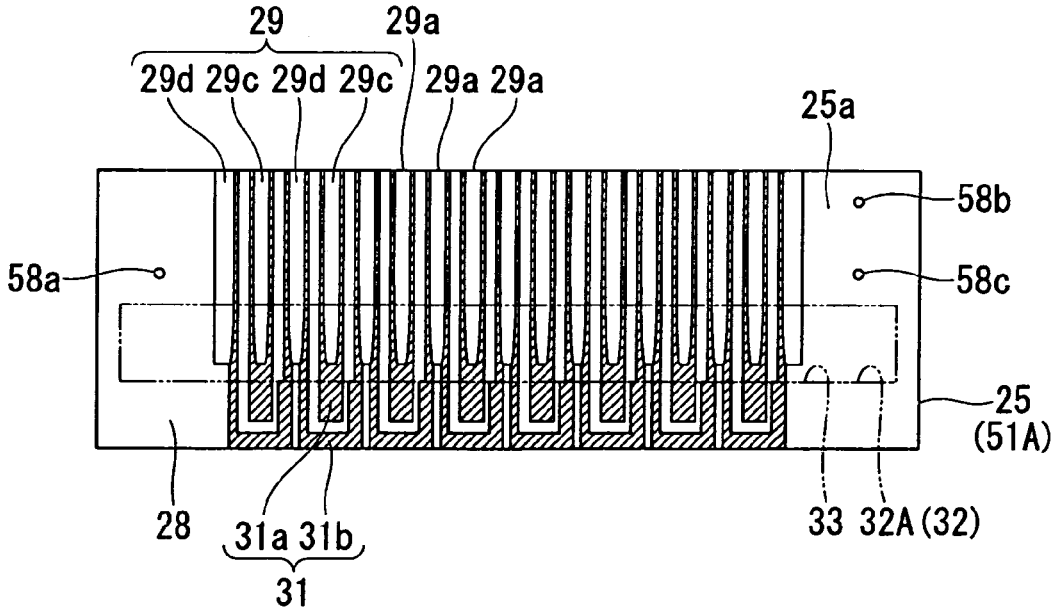

Further, in the first embodiment of the present invention, in the plurality of channels 29, the common grooves 29*c* capable of discharging ink are alternately formed and the active grooves 29*d* which do not discharge ink are formed therebetween, but the present invention is not limited thereto. In other words, as shown in FIGS. 16 and 17, in the cover plate substrate 26 of each of the head chips 21, instead of forming the plurality of through holes 33*c*, the entire main body part 33 of the ink chamber 32 may be penetrated so as to communicate with all the channels 29. Note that, in this case, in can be discharged from all the channels 29. As a result, the nozzle holes 23*a* are formed in the nozzle plate 23 so as to correspond to all the channels 29.

Second Embodiment

FIGS. 18 to 20B each show a second embodiment of the present invention. In the second embodiment of the present invention, components common to the components used in the above-mentioned embodiment are denoted by the same reference symbols, and descriptions thereof are omitted.

Figure 20A:
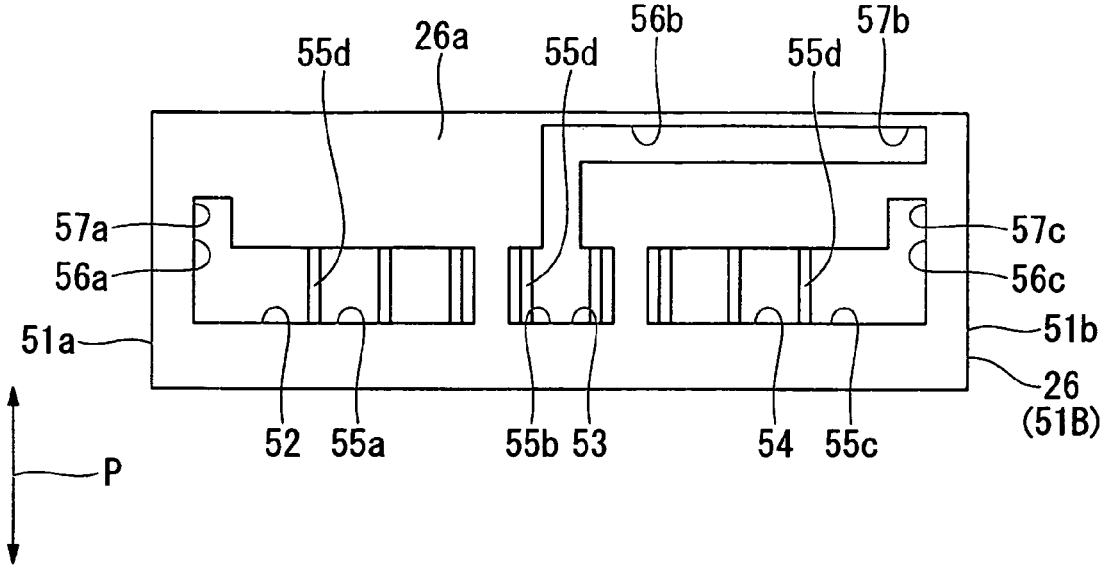
FIGS. 20A and 20B are top views each showing a substrate of another head chip in the head chip unit according to the second embodiment of the present invention.
Figure 20B:
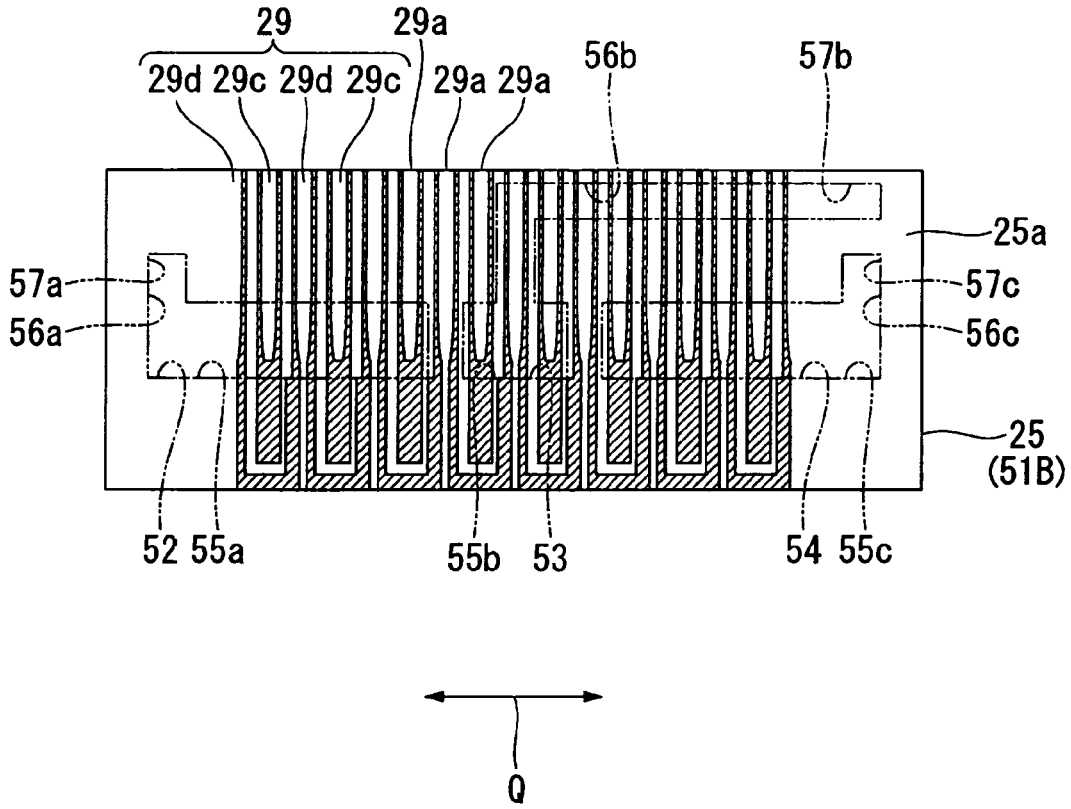

As shown in FIGS. 18 to 20B, a head chip unit 50 according to the second embodiment of the present invention includes head chips 51 (51A and 51B) laminated in two layers. The head chips 51A and 51B each include the actuator substrate 25 and the cover plate substrate 26, as the head chip main body 27. In this case, FIG. 19A shows the cover plate substrate 26 of the head chip 51A, FIG. 19B shows the actuator substrate 25 of the head chip 51A, FIG. 20A shows the cover plate substrate 26 of the head chip 51B, and FIG. 20B shows the actuator substrate 25 of the head chip 51B. The actuator substrate 25 of each of the head chips 51 has the substrate connecting surface 28, the plurality of channels 29, and the electrodes 31 formed therein as in the first embodiment. In the head chip 51A in which the cover plate substrate 26 is allowed to expose to one side, the cover plate substrate 26 includes only the main body part 33 as the ink chamber 32. In the head chip 51B, the cover plate 26 includes a first ink chamber 52, a second ink chamber 53, a third ink chamber 54, and a plurality of ink chambers which do not interfere with each other. The first ink chamber 52 includes a main body part 55*a*, an introduction part 56*a*, and a supply part 57*a*. The second ink chamber 53 includes a main body part 55*b*, an introduction part 56*b*, and a supply part 57*b*. The third ink chamber 54 includes a main body part 55*c*, an introduction part 56*c*, and a supply part 57*c*. The main body part 55*a* of the first ink chamber 52 is formed on a side of one side edge 51*a* in the arrangement direction Q, and has a through hole 55*d* formed therein so as to communicate with the plurality of channels 29 on the one side edge 51*a* side. The main body part 55*c* of the third ink chamber 54 is formed on a side of another side edge 51*b* in the arrangement direction Q, and has the through hole 55*d* formed therein so as to communicate with the plurality of channels 29 on the another side edge 51*b* side. The main body 55*b* of the second ink chamber 53 is formed between the main body part 55*a* of the first ink chamber 52 and the main body part 55*c* of the third ink chamber 54 in the arrangement direction Q, and has the through hole 55*d* formed therein so as to communicate with the plurality of channels 29 formed at a central portion. In addition, the introduction parts 56*a*, 56*b*, and 56*c* are connected to the corresponding main body parts 55*a*, 55*b*, and 55*c*, respectively, and extend to positions where the introduction parts 56*a*, 56*b*, and 56*c* are not overlapped with the plurality of channels 29 and the ink chambers 32 of the head chip 51A on the one side, and the supply parts 57*a*, 57*b*, and 57*c* are formed. Further, ink supply holes 58*a*, 58*b*, and 58*c* communicating with the supply parts 57*a*, 57*b*, and 57*c*, respectively, are formed so as to be opened in the cover plate substrate 26 of the head chip 51A.

In the head chip unit 50 according to the second embodiment of the present invention, a plurality of ink chambers are formed in a single head chip 51B, the supply parts 57*a*, 57*b*, and 57*c* are respectively formed in the plurality of ink chambers, and the ink supply holes 58*a*, 58*b*, and 58*c* are formed so as to correspond to the supply parts, thereby making it possible to supply different ink to be discharged with a single head chip 51B. In addition, in the second embodiment of the present invention, different ink is also supplied to the head chip 51A, thereby discharging four colors of ink from one head chip unit 50, thereby enabling printing. Note that, in the second embodiment of the present invention, the head chip is formed in two layers. Alternatively, the head chip having a plurality of ink chambers may be laminated in a plurality of layers.

As described above, the embodiments of the present invention are described with reference to the drawings. The detailed structures of the present invention are not limited to those embodiments, and various design modifications and the like can be made within a range without departing from the gist of the present invention.

What is claimed is:

1. A method of producing a head chip unit, comprising:

a head chip forming step of forming each of a plurality of head chips having a substantially plate-shaped main body comprised of a first substrate and a second substrate by forming in the first substrate at least one channel that extends generally along a first direction from one edge side to another edge side of the main body and that has an opening at the another edge side, forming in the second substrate at least one ink chamber having a supply part and extending generally along a second direction substantially orthogonal to the first direction and communicating with the at least one channel on the one edge side of the main body, and forming at least one ink supply hole that penetrates the main body and communicates with the supply part of the at least one ink chamber; and a lamination step of laminating the plurality of head chips relative one another in a plurality of layers along a laminating direction so that the supply part of at least one of the head chips does not overlap the at least one channel and the at least one ink chamber in the laminated direction of another of the head chips laminated on a surface of the at least one head chip;

wherein the at least one ink supply hole of the another head chip is formed so that it does not overlap the ink chamber of the another head chip in the laminating direction.

2. A method of producing a head chip unit according to claim 1, wherein:

the step of forming the at least one channel and the at least one ink chamber further comprises, for the at least one head chip, forming a plurality of the channels and forming a plurality of the ink chambers so as to communicate with the respective channels, each of the plurality of ink chambers having the corresponding supply part; and the step of forming the at least one ink supply hole further comprises forming a plurality of the ink supply holes that penetrate the another of the head chip so as to communicate with the respective supply parts of the ink chambers of the at least one head chip.

3. A method of producing a head chip unit according to claim 2; wherein the step of forming the plurality of ink chambers further comprises forming the at least one ink chamber with a main body part that extends generally along the second direction and communicates with the at least one channel, and with an introduction part that extends generally along the first direction and connects to the main body part at a position where the introduction part is not overlapped with the channel in the lamination.

4. A method of producing a head chip unit according to claim 1; wherein the step of forming the at least one ink chamber further comprises forming the at least one ink chamber with a main body part that extends generally along the second direction and communicates with the at least one channel, and with an introduction part that extends generally along the first direction and connects to the main body part at a position where the introduction part is not overlapped with the channel in the laminating.

5. A head chip unit, comprising:

a plurality of head chips laminated relative one another in a plurality of layers along a laminating direction, each of the head chips comprising a substantially plate-shaped main body formed of a first substrate having at least one channel and a second substrate disposed on a surface of the first substrate and having at least one ink chamber communicating with the at least one channel, the at least one channel having an opening and extending generally along a first direction from a first edge side to a second edge side of the at least one channel with the opening provided at the second edge side, and the at least one ink chamber extending generally along a second direction substantially orthogonal to the first direction and communicating with the at least one channel on the first edge side of the at least one channel;

wherein the at least one ink chamber of at least one of the head chips has a supply part formed at a position where the supply part is not overlapped with the at least one channel and the at least one ink chamber of another of the head chips in the laminating direction, the another head chip being laminated on a surface of the at least one head chip; and wherein the another head chip has at least one ink supply hole that penetrates the another head chip to communicate with the supply part of the at least one head chip and that does not overlap the ink chamber of the another head chip in the laminating direction.

6. A head chip unit according to claim 5; wherein the plurality of head chips comprises four head chips each having the corresponding ink chamber with the supply part and the ink supply hole communication with the supply part.

7. An inkjet head comprising the head chip unit according to claim 6.

8. An inkjet head comprising the head chip unit according to claim 5.

9. An inkjet printer comprising the inkjet head according to claim 8.

10. A head chip unit according to claim 5, wherein:

the at least one channel and the at least one ink chamber of the at least one head chip comprises a plurality of channels and a plurality of ink chambers communicating with the respective channels, each of the ink chambers having a corresponding supply part; and the at least one ink supply hole of the another head chip comprises a plurality of ink supply holes that penetrate the another head chip to communicate with the respective supply parts of the at least one head chip.

11. A head chip unit according to claim 10; wherein the plurality of head chips comprises four head chips each having the corresponding ink chamber with the supply part and the ink supply hole communication with the supply part.

12. An inkjet head comprising the head chip unit according to claim 10.

13. A head chip unit according to claim 10; wherein each of the ink chambers has a main body part extending generally along the second direction and communicating with the channel, and an introduction part having the supply part and extending generally along the first direction and connecting to the main body part at a position where the introduction part is not overlapped with the channel in the laminating direction.

14. A head chip unit according to claim 5; wherein the ink chamber of each head chip has a main body part extending generally along the second direction and communicating with the channel, and an introduction part having the supply part and extending generally along the first direction and connecting to the main body part at a position where the introduction part is not overlapped with the channel in the laminating direction.

15. An inkjet head comprising the head chip unit according to claim 14.

16. A head chip unit comprising:

a first head chip having a first ink chamber configured to contain first ink and having a first channel in communication with the first ink chamber for receiving the first ink from the first ink chamber and via which the first ink is discharged in an ink supply direction of the head chip unit; and a second head chip laminated with the first head chip along a laminating direction generally orthogonal to the ink supply direction, the second head chip having a second ink chamber with an ink supply part configured to receive second ink different from the first ink, a second channel in communication with the second ink chamber for receiving the second ink from the ink supply part and via which the second ink is discharged in the ink supply direction, and an ink supply hole through which the second ink is supplied into the ink supply part of the second ink chamber, the ink supply hole extending in the laminating direction so that the ink supply hole does not overlap the first ink chamber and the first channel of the first head chip.

17. A head chip according to claim 16; further comprising at least one third head chip laminated with the first and second head chips along the laminating direction, the at least one third head chip having a third ink chamber with an ink supply part that is configured to receive third ink different from the first and second inks and that does not overlap the second channel of the second head chip, a third channel in communication with the third ink chamber for receiving the third ink from the ink supply part of the third ink chamber and via which the third ink is discharged in the ink supply direction, and an ink supply hole through which the third ink is supplied into the ink supply part of the third ink chamber.

18. A head chip according to claim 17; wherein the ink supply part of the third ink chamber has a portion that overlaps with the supply part of the second ink chamber and another portion that does not overlap with the supply part of the second ink chamber.

19. A head chip according to claim 18; wherein the at least one third head chip comprises two third head chips.

20. An inkjet head comprising the head chip unit according to claim 17.

21. An inkjet printer comprising the inkjet head according to claim 20.

22. An inkjet head comprising the head chip unit according to claim 16.

23. An inkjet printer comprising the inkjet head according to claim 22.

* * * * *